US012565735B2

(12) United States Patent
Hejduk et al.

(10) Patent No.: US 12,565,735 B2
(45) Date of Patent: Mar. 3, 2026

(54) METHODS FOR PRODUCING PULP AND PAPER PRODUCTS FROM PLANTS HAVING BAST AND HURD FIBERS

(71) Applicant: GOLDCUP 33965 AB (UNC. HEJMAS AGRIFIBRE TECHNOLOGIES AB), Karlstad (SE)

(72) Inventors: Marek Hejduk, Calgary (CA); Andrew Lee Ondra Maseja, Calgary (CA)

(73) Assignee: GOLDCUP 33965 AB (UNC. HEJMAS AGRIFIBRE TECHNOLOGIES AB), Karlstad (SE)

( * ) Notice: Subject to any disclaimer, the term of this patent is extended or adjusted under 35 U.S.C. 154(b) by 206 days.

(21) Appl. No.: 18/270,602

(22) PCT Filed: Dec. 30, 2021

(86) PCT No.: PCT/CA2021/051902

§ 371 (c)(1),
(2) Date: Jun. 30, 2023

(87) PCT Pub. No.: WO2022/140857

PCT Pub. Date: Jul. 7, 2022

(65) Prior Publication Data

US 2024/0295074 A1 Sep. 5, 2024

Related U.S. Application Data

(60) Provisional application No. 63/132,565, filed on Dec. 31, 2020.

(51) Int. Cl.
*D21B 1/02* (2006.01)
*D21B 1/12* (2006.01)
(Continued)

(52) U.S. Cl.
CPC ..... *D21D 1/02* (2013.01); *D21B 1/021* (2013.01); *D21B 1/028* (2013.01); *D21B 1/12* (2013.01);
(Continued)

(58) Field of Classification Search
CPC ..... D21B 1/021; D21B 1/028; D21B 1/02; D21H 11/12
See application file for complete search history.

(56) References Cited

U.S. PATENT DOCUMENTS 4,106,979 A 8/1978 Ruffini et al.
10,745,859 B2 8/2020 Ramaratnam et al.
(Continued)

FOREIGN PATENT DOCUMENTS

EP 3334855 B1 * 5/2023 ..... D01C 1/00
JP H11-507416 A 6/1999
(Continued)

OTHER PUBLICATIONS

Smook, Handbook for Pulp and Paper Technologists, 1992, Angus Wilde Publications, 2nd edition, chapters 13 and 16. (Year: 1992).*
(Continued)

*Primary Examiner* — Anthony Calandra
(74) *Attorney, Agent, or Firm* — Dickinson Wright PLLC

(57) ABSTRACT

Disclosed herein are methods for producing a pulp or paper product from a plant material having bast and hurd fibers, such as a cannabis plant material. For example, there is method for producing a pulp or paper product from a plant material having bast and hurd fibers, the method comprising processing of a plant hurd fiber material into a hurd fiber pulp or pulp slurry in a first stream; processing of a plant bast fiber material into a bast fiber pulp or pulp slurry in a second stream; blending of the hurd fiber pulp or pulp slurry and the bast fiber pulp or pulp slurry to provide a blended pulp or
(Continued)

pulp slurry; and producing the pulp or the paper product from the blended pulp or pulp slurry. Also provided are pulp and paper products produced from such methods. Also provided are cannabis pulp and paper products.

35 Claims, 4 Drawing Sheets

(51) Int. Cl.

| | |
|---|---|
| ***D21C 1/02*** | (2006.01) |
| ***D21C 1/04*** | (2006.01) |
| ***D21D 1/02*** | (2006.01) |
| ***D21D 5/24*** | (2006.01) |
| ***D21H 11/12*** | (2006.01) |

(52) U.S. Cl.
CPC ..... *D21C 1/02* (2013.01); *D21C 1/04* (2013.01); *D21D 5/24* (2013.01); *D21H 11/12* (2013.01)

(56) References Cited

U.S. PATENT DOCUMENTS

| | | | | |
|---|---|---|---|---|
| 2004/0200586 | A1* | 10/2004 | Herkel | D21C 9/163 162/25 |
| 2014/0093705 | A1* | 4/2014 | Shi | B65D 81/05 428/182 |
| 2016/0130762 | A1* | 5/2016 | Ramaratnam | D21H 27/002 162/175 |
| 2019/0264385 | A1 | 8/2019 | Pauwels et al. | |

FOREIGN PATENT DOCUMENTS

| | | |
|---|---|---|
| JP | 2001-288686 A | 10/2001 |
| WO | WO 2017/068437 | 4/2014 |

OTHER PUBLICATIONS

CNBM International, Chemi-Mechanical Pulping, 2018 [downloaded online May 23, 2025 from archive.org] (Year: 2018).*
Xu, Eric, A New Concept in Alkaline Peroxide Refiner Mechanical Pulping, 1999 International Mechanical Pulping Conference Proceedings (Year: 1999).*
Xu et al., APMP (Alkaline Peroxide Mechanical Pulping) Pulps from Non-Wood Fibers,2001, TAPPI 2001 Pulping Conference (Year: 2001).*
European Patent Office; Extended European Search Report in EP Application No. 21912382.5; Oct. 30, 2024; 9 pgs.
Villar, J.C. et al.; Improving the use of kenaf for kraft pulping by using mixtures of bast and core fibers; Industrial Crops and Products; Mar. 1, 2009; pp. 301-307; vol. 29 No. 2-3; Elsevier.
Danielewicz, D. et al.; Properties and fibre characterisation of bleached hemp, birch and pine pulps: a comparison; Cellulose; Sep. 15, 2017; pp. 5173-5186; vol. 24 No. 11; Springer Netherlands.
International Search Report and Written Opinion mailed Apr. 18, 2024 for PCT/CA2021/051902.
Keenan et al., Paper Trail: The Decline of Canada's forestry industry, The Glove and Mail, Dec. 5, 2014, pp. 1-11, https://www.theglobeandmail.com/report-on-business/economy/paper-trail-the-fall-of-forestry/article21967746/, accessed on Oct. 21, 2024.
Van Der Werf et al., Quality of Hemp (*Cannabis sativa* L.) stems as a raw material for paper, Industrial Crops and Products, 1994, vol. 2, pp. 219-227, Elsevier Science B.V.
Olev Trass & Constantin Delibas, Refining Hemp Fibers for Papermaking, Journal of Natural Fibers, 2005, vol. 2, issue 1, pp. 59-68.
Forest Products Laboratory, Pulp Yields for Various Processes and Wood Species, U.S. Forest Service Research Note, Feb. 1964, 6 pgs., Forest Service U.S. Department of Agriculture, Madison Wisconsin.
Suardana et al., Mechanical Properties of Hemp Fibers and Hemp/PP Composites: effects of Chemical Surface Treatment, Material Physics and Mechanics, Dec. 19, 2010, vol. 11, pp. 1-8, Institute of Problems of Mechanical Engineering.
Varghese et al., Surface Modification of Natural Fibers, Biodegradable and Biocompatible Polymer Composites, 2018, vol. 5, pp. 115-155, Elsevier Ltd.
University of Minnesota, Water Use in Pulp & Paper Mills, 3 pgs., www.mntap.umn.edu/industries/facility/paper/water/ accessed on Oct. 21, 2024, Regents of the University of Minnesota.
Haggith et al., The State of the Global Paper Industry, Shifting Seas: New Challenges and Oppostunities for Forests, People and the Climate, Environmental Paper Network, 2018, 90 pgs., Environmental Paper Network.
ETSAP—Energy Technology Systems Analysis Programme, Annex XIII: Tools for Analysis of a Future Energy Revolution, Minutes of the 70th Executive Committee Meeting, Nov. 18, 2016, 7 pgs., CIEMAT, Madrid, Spain.
Bryan Bogdanski, The rise and fall of the Canadian pulp and paper sector, The Forestry Chronicle, 2014, vol. 90 issue 6, pp. 785-793.
Office Action and English translation in Japanese Application No. 2023-538998 dated Dec. 5, 2025, 14 pages.

* cited by examiner

METHODS FOR PRODUCING PULP AND PAPER PRODUCTS FROM PLANTS HAVING BAST AND HURD FIBERS

This application is a U.S. national phase of PCT International Patent Application No. PCT/CA2021/051902, filed Dec. 30, 2021, which claims priority to and benefit of U.S. Patent Application No. 63/132,565, filed on Dec. 31, 2020, which are hereby incorporated by reference in their entireties.

TECHNICAL FIELD

The present disclosure generally relates to pulp and paper products. More specifically, the present disclosure relates to the production of pulp and paper products using a plant material having bast and hurd fibers, such as cannabis plant materials.

BACKGROUND

The pulp and paper industry conventionally uses wood from trees such as softwoods including spruce, pine, fir, and larch, and hardwoods including eucalyptus, aspen and birch, to produce pulp. Such processes are generally referred to as pulping processes. From the pulp, paper products such as office paper, newsprint paper, cardboard, and the like may be produced.

The pulping processes used by the pulp and paper industry, however, are not environmentally or economically sustainable. Wood pulping processes require harvesting significant amounts of lumber, from which pulp is then produced using energy-intensive processes that generally require the use of environmentally hazardous chemicals. One such process is the Kraft pulping process, which typically requires about 18.5 GJ of energy and about 65,000 L of water per tonne of lumber pulp produced (depending on tree variety) and involves the use of environmentally hazardous chemicals such as chlorine dioxide, sulfates including sodium sulfate and thiosulfate, sulfides, and hydro sulfites. Another example is wood pulping processes employing thermomechanical processes, which typically require about 9.2 GJ and about 124,000 L of water per tonne of lumber pulp produced (depending on tree variety) and may also involve the use of environmentally hazardous chemicals such as those listed above.

Further, not only are conventional pulping processes environmentally unsustainable, they are also not time and cost effective. For example, existing forestry practices require about 60 years to produce 100 tonnes of biomass useable for subsequent pulping processes due in part to the time it takes for freshly-planted trees to reach maturity. At the same time, because the trees cannot grow fast enough to meet lumber demands, locations suitable for lumber harvesting are becoming increasingly remote, which significantly increases the costs associated therewith. Under current conditions, the cost of harvesting lumber is increasing and outstripping the ability of the pulp and paper industry to reliably generate profit.

Thus, there exists a need for an alternative to conventional wood pulping and wood pulping processes that is capable of producing pulp and paper products in an efficient, environmentally sustainable, and cost-effective manner.

SUMMARY

The present disclosure recognizes that there are problems in the current existing technologies in respect of wood pulping.

In an embodiment, the present disclosure relates to a method for producing a pulp or paper product from a plant material having bast and hurd fibers, the method comprising: providing one or both of a plant bast fiber material and a plant hurd fiber material, and optionally a xylem material; performing a mechanical refining of the one or both of the plant bast fiber material and plant hurd fiber material, and optionally the xylem material, to form a pulp slurry; and producing the pulp or the paper product from the pulp slurry. In an embodiment, the plant material having bast and hurd fibers is a cannabis plant material, such as hemp.

In an embodiment, the present disclosure relates to a method for producing a pulp or paper product from a plant material having bast and hurd fibers, the method comprising processing of a plant hurd fiber material into a hurd fiber pulp or pulp slurry in a first stream; processing of a plant bast fiber material into a bast fiber pulp or pulp slurry in a second stream; blending of the hurd fiber pulp or pulp slurry and the bast fiber pulp or pulp slurry to provide a blended pulp or pulp slurry; and producing the pulp or the paper product from the blended pulp or pulp slurry, wherein the first stream and the second stream are performed separate from each other. In an embodiment, the plant material having bast and hurd fibers is a cannabis plant material, such as hemp.

In an embodiment, the present disclosure relates to a method for producing a pulp or paper product from a plant material having bast and hurd fibers, the method comprising decorticating a plant material having bast and hurd fibers to separate and provide a plant bast fiber material and a plant hurd fiber material; performing a mechanical refining of the plant hurd fiber material in a first stream to form a hurd fiber pulp or pulp slurry; performing a steam and pressure refining of the plant bast fiber material in a second stream to form a bast fiber pulp or pulp slurry; blending the bast fiber pulp or pulp slurry and the hurd fiber pulp or pulp slurry to form a blended pulp or pulp slurry; and producing the pulp or the paper product from the blended pulp or pulp slurry. In an embodiment, the mechanical refining in the first stream is an atmospheric mechanical refining. In an embodiment, steam and pressure refining in the second stream comprises one or more steps of chemical pulping of the plant bast fiber material. In an embodiment, the plant material having bast and hurd fibers is a cannabis plant material, such as hemp.

In an embodiment, the present disclosure relates to a method for producing a pulp or paper product from a cannabis plant material, the method comprising: decorticating a cannabis plant material to remove a cannabis plant bast fiber material therefrom and provide a decorticated cannabis plant hurd fiber material; performing an atmospheric mechanical refining of the decorticated cannabis plant hurd fiber material to form a hurd fiber pulp or pulp slurry; performing a steam and pressure refining of the cannabis plant bast fiber material to form a bast fiber pulp or pulp slurry; blending the bast fiber pulp or pulp slurry and the hurd fiber pulp or pulp slurry to form a blended pulp or pulp slurry; and producing the pulp or the paper product from the blended pulp slurry. In an embodiment, steam and pressure refining comprises one or more steps of chemical pulping of the plant bast fiber material.

In an embodiment, the present disclosure relates to a method for producing a pulp or paper product from a cannabis plant material, the method comprising: providing a decorticated cannabis plant material; performing an atmospheric mechanical refining of the decorticated cannabis plant material to form a pulp slurry; and producing the pulp or the paper product from the pulp slurry. In an embodiment, the method further comprises separate refining of bast and hurd fibers from the decorticated cannabis plant material, for example atmospheric mechanical refining of hurd fibers and steam/pressure or chemical refining of bast fibers.

In an embodiment, the present disclosure relates to a pulp or paper product produced by the methods of the present disclosure. In an embodiment, the pulp or paper product consists essentially of a cannabis, flax, sunn, kenaf, mulberry, or mitsumata plant material. In a particular embodiment, the pulp or paper product consists essentially of a cannabis or flax plant material. In a particular embodiment, the pulp or paper product consists essentially of a cannabis plant material, such as hemp. In an embodiment, the pulp or paper product comprises 100% w/w of a cannabis, flax, sunn, kenaf, mulberry, or mitsumata plant material. In a particular embodiment, the pulp or paper product comprises 100% w/w of a cannabis or flax plant material. In a particular embodiment, the pulp or paper product comprises 100% w/w of a cannabis plant material, such as hemp.

In an embodiment, the present disclosure relates to a pulp or paper product that consists essentially of a cannabis, flax, sunn, kenaf, mulberry, or mitsumata plant material and has a ratio of between 5:1 and 1:5 of hurd fiber pulp:bast fiber pulp on a volume/volume (v/v) basis.

In an embodiment, the present disclosure relates to a cannabis pulp or paper product that consists essentially of a cannabis plant material and has a ratio of between 5:1 and 1:5 of hurd fiber pulp:bast fiber pulp on a v/v basis. In an embodiment, the cannabis pulp or paper product comprises 100% cannabis plant material. In an embodiment, the cannabis pulp or paper product comprises between about 20% v/v to about 80% v/v of the hurd fiber pulp.

Other aspects and features of the methods of the present disclosure will become apparent to those ordinarily skilled in the art upon review of the following description of specific embodiments.

BRIEF DESCRIPTION OF THE DRAWINGS

These and other features of the present disclosure will become more apparent in the following detailed description in which reference is made to the appended drawings. The appended drawings illustrate one or more embodiments of the present disclosure by way of example only and are not to be construed as limiting the scope of the present disclosure.

DETAILED DESCRIPTION

Figure 1:
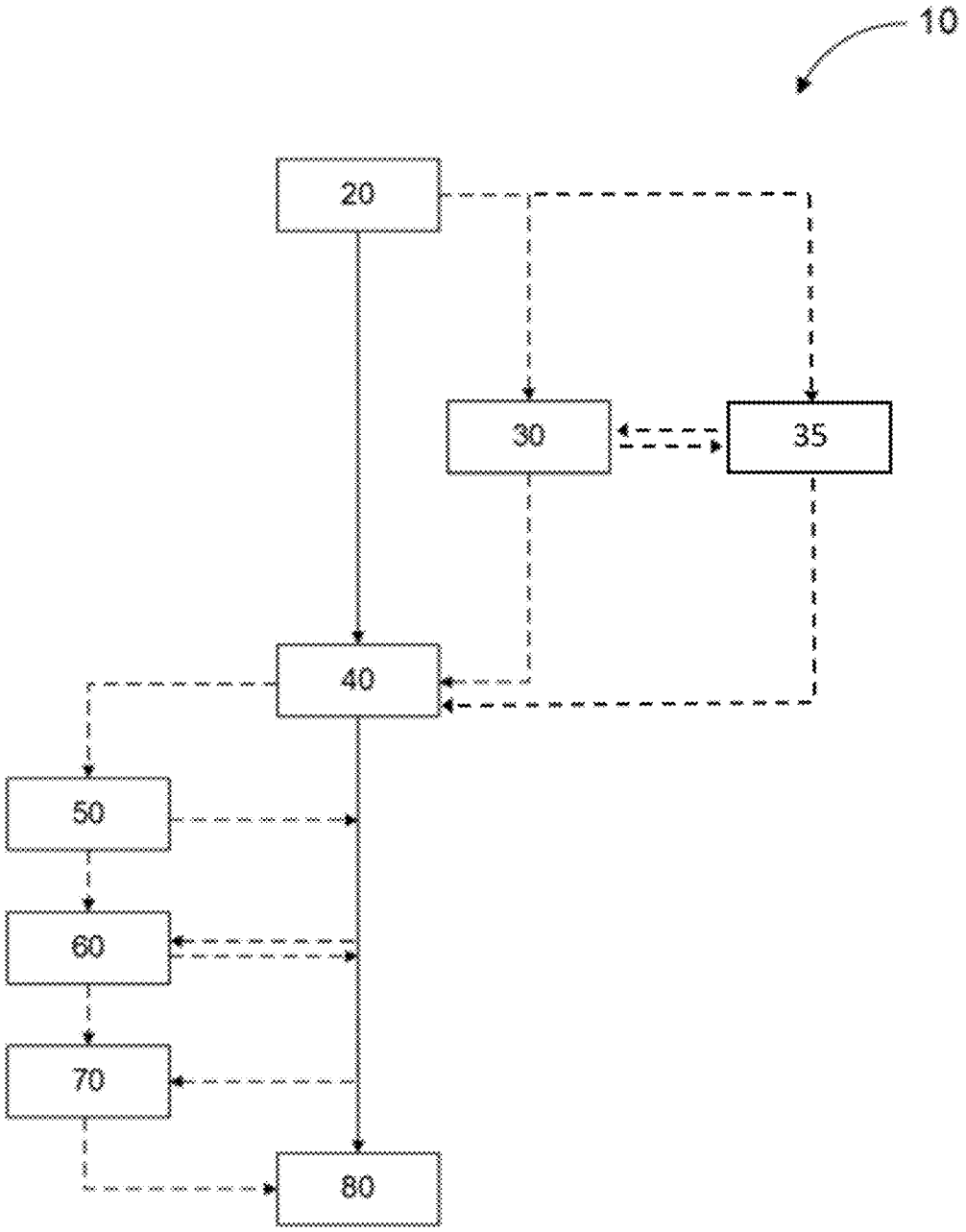
FIG. 1 shows a flowchart representing a method for producing a pulp or paper product from a cannabis plant material according to an embodiment of the present disclosure, wherein broken arrows represent exemplary embodiments.

Cannabis plants have been used industrially for thousands of years and are presently used to manufacture commercial products such as textiles, clothing, biodegradable plastics, paints, insulation, biofuels, food, animal feeds, etc.

Cannabis plants have also been used by the pulp and paper industry, albeit only in a limited capacity. For example, cannabis plant material may be added to a conventional wood pulping process in an amount of about 5% to about 15% as a filler in order to market the produced pulp or paper product as "environmentally friendly".

There are a number of reasons that the pulp and paper industry does not use cannabis plants in a greater capacity. For example, pulp and paper companies have already invested significantly in acres of forest for the harvesting of lumber therefrom and thus may not be motivated to divest or invest further in supplementary sources of biomass.

Further, conventional wood pulping processes are not well-suited for the processing of other biomass sources. In more detail, industry-standard wood pulping processes have been optimized over hundreds of years for wood biomass and are not particularly adaptable for other types of biomass, which will generally have significantly different biological make-ups. For example, conventional wood pulping processes generally rely on the use of steam during pre-treatment and various processing steps to soften the wood so that fibers contained therein may be more easily extracted therefrom. However, for cannabis plants, the use of steam during pre-treatment or other processing steps may, in some cases, denature certain types of fibers thereof such that any pulp produced therefrom may be unusable.

As well, because cannabis plant material pulping is generally attempted using conventional wood pulping processes, it is generally understood in the pulp and paper industry that it is not economically viable to produce a pulp or paper product using only cannabis plant material. Economical methods and processes for producing a pulp or paper product using only cannabis plant material are generally lacking. Thus, pulping processes relying solely on cannabis plant material as the starting biomass are generally discouraged.

Furthermore, whereas about 70% to about 90% of the biomass of wood is suitable to produce pulp and paper products, historically only about 30% of the biomass of cannabis plants is suitable for pulp and paper product production. Thus, it is generally thought by those in the pulp and paper industry that cannabis plants represent a less efficient source of biomass for pulp or paper product production.

However, despite the current thinking and practices in the pulp and paper industry, the present disclosure provides pulping processes that are economically and environmentally sustainable using as an alternative biomass source plants having bast and hurd fibers, such as for example cannabis plants. Ultimately, the disclosed methods for producing pulp or paper products from plant materials having bast and hurd fibers, such as cannabis plant materials, afford a number of advantages over conventional wood pulping processes.

In more detail, the methods of the present disclosure are capable of producing pulp or paper products from plant materials having bast and hurd fibers without the need for environmentally hazardous chemicals such as those used in the conventional wood pulping processes. Instead, in some embodiments, the methods of the present disclosure may advantageously be performed using only water and, in some embodiments, oxygen and/or hydrogen peroxide. In some embodiments, the methods of the present disclosure may include chemical pulping steps or chemical pre-treatment steps. However, these chemical applications may be characterized as a 'light' chemical treatments in comparison to conventional wood pulping processes, for example by using reduced quantities of chemicals and/or by using less hazardous chemicals. As will be appreciated by those of ordinary skill in the art, chemicals that may be used in embodiments of the methods of the present disclosure do not bear a significant environmental impact, if any.

Further, embodiments of the methods of the present disclosure are capable of producing plant pulp or paper products using significantly less energy and less water than existing wood pulping processes. As previously described herein, Kraft wood pulping processes typically require about 18.5 GJ of energy and about 65,000 L of water to produce 1 tonne of wood pulp, while exclusively thermomechanical wood pulping processes require about 9.2 GJ of energy and about 124,000 L of water to produce the same. In contrast, embodiments of the methods of present disclosure are capable of producing 1 tonne of plant pulp (e.g. cannabis plant pulp) using significantly less energy and water. In particular embodiments, the methods disclosed herein may use less than about 5% of the energy and less than about 33% of the water required by the Kraft wood pulping process, and may use less than about 10% of the energy and less than about 17% of the water required for exclusively thermomechanical wood pulping processes. It will be appreciated that, as a result, embodiments of the methods of the present disclosure may be less taxing on the environment and thus more environmentally and economically sustainable than conventional wood pulping processes.

Although, as previously described herein, plants having bast and hurd fibers (e.g. cannabis) generally have less biomass suitable for production of pulp or paper products as compared to conventional wood sources, the methods disclosed herein are capable of improving usage of such plant biomass.

Furthermore, in some embodiments, the methods of the present disclosure may be completed with fewer processing steps as compared to conventional wood pulping processes, such as for example Kraft or exclusively thermomechanical wood pulping processes that require a number of pre-treatment and/or auxiliary steps (e.g. to properly manage toxic chemical byproducts) and with a minimal amount of resources, as described above. As well, plants having bast and hurd fibers (e.g. cannabis, flax, sunn, kenaf, mulberry, or mitsumata) grow considerably faster than trees. In fact, it takes existing forestry practices about 60 years to produce 100 tonnes of raw biomass for pulp production, while it only takes about 36 months to produce an equivalent amount of cannabis plant biomass for pulp production.

Advantageously, in some embodiments, the present disclosure relates to a two-stream method for producing the pulp and paper products, whereby the plant bast fiber material is processed separately and by a different process than the plant hurd fiber material. The pulp or pulp slurry produced in each stream may then be blended together to prepare the ultimate pulp or paper product. In some embodiments, the two stream process has been found advantageous in that certain processing conditions in a single stream either under or over process one of the components (bast or hurd) when targeting an ideal pulp of the other component. For example, under certain conditions of a single stream process favourable to preparing a bast fiber pulp, the hurd fiber may not pulp and may remain in its base form. In contrast, under certain conditions of a single stream process favourable to preparing a hurd fiber pulp, the bast fiber may be over-processed rendering it useless.

Although counter-intuitive to process the bast and hurd fiber materials in separate streams, embodiments of the methods disclosed herein render such processing of bast and hurd fiber materials by separate streams an economically viable option. In an embodiment of the two-stream processes herein, the bast fiber material is processed under a light chemical pulping procedure (e.g. a low bicarbonate solution). In an embodiment of the two-stream processes herein, the hurd fiber material is processed under a mechanical refining process (e.g. an atmospheric mechanical refining). Both streams may optionally include a chemical pre-treatment (e.g. sulfuric acid, sodium hydroxide or citric acid) or an oxygen delignification pre-treatment.

Advantageously, embodiments of the methods disclosed herein are capable of providing paper-grade pulp from hemp hurd and bast fibers. Additional advantages will be discussed below and will be readily apparent to those of ordinary skill in the art upon reading the present disclosure.

Reference will now be made in detail to exemplary embodiments of the disclosure, wherein numerals refer to like components, examples of which are illustrated in the accompanying drawings that further show example embodiments without limitation.

In one embodiment, the present disclosure relates to a method for producing a pulp or paper product from a plant material having bast and hurd fibers, the method comprising:

- providing one or both of a plant bast fiber material and a plant hurd fiber material, and optionally a xylem material;
- performing a mechanical refining of the one or both of the plant bast fiber material and plant hurd fiber material, and optionally the xylem material, to form a pulp slurry; and
- producing the pulp or the paper product from the pulp slurry.

In another embodiment, the present disclosure relates to a two-stream method for producing a pulp or paper product from a plant material having bast and hurd fibers. In an exemplary embodiment, the two-stream method comprises:

- decorticating a plant material having bast and hurd fibers to separate and provide a plant bast fiber material and a plant hurd fiber material;
- performing a mechanical refining of the plant hurd fiber material in a first stream to form a hurd fiber pulp or pulp slurry;
- performing a steam and pressure refining of the plant bast fiber material in a second stream to form a bast fiber pulp or pulp slurry;
- blending the bast fiber pulp or pulp slurry and the hurd fiber pulp or pulp slurry to form a blended pulp or pulp slurry; and
- producing the pulp or the paper product from the blended pulp or pulp slurry.

As used herein, "pulp" refers to plant biomass that has been processed to a form suitable for subsequent conversion to one or more paper products. Pulp generally comprises fibrous plant material and may be in the form of a matted or felted sheet. The pulp may be a dried material or may still retain some moisture (e.g. wet, moist or damp). Typically, in the context of the present disclosure, "pulp" is a soft, moist material; whereas, in contrast, a "pulp slurry" is a flowable suspension of particles or fibrous material in a liquid. For example, as used herein, a "pulp slurry" refers to a mixture comprising pulp and a liquid (e.g. water) that can be processed to extract the pulp therefrom. The "pulp slurry"

may contain trace amounts of other materials used in processing, such as in certain embodiments oxygen, sulfites, carbon dioxide, etc.

As used herein, "paper product" refers to any product producible from a pulp. Examples of paper products include coated or uncoated repro paper (e.g. commercial printing paper, office paper, etc.), newsprint paper, paperboard, cardboard, fine art paper, etc. Without limitation, the paper product may be any product that traditionally would be made from a wood or lumber pulp.

As used herein, "plant material having bast and hurd fibers" refers to plant material from any species or type of plant that has bast fibers and hurd fibers. These types of fibers are known in the art and are typically found in certain dicotyledonous plants. Sometimes these plants are referred to as bast fiber plants. In exemplary and non-limiting embodiments, the plant material having bast and hurd fibers is plant material from a cannabis plant, a flax plant, a sunn plant, a kenaf plant, a mulberry plant, or a mitsumata plant.

In the context of the present disclosure, the term "cannabis plant" encompasses any type of cannabis plant globally, including for example any plant of the family Cannabaceae. The species of cannabis plants typically recognized are *Cannabis sativa, Cannabis indica* and *Cannabis ruderalis*. In an embodiment, the cannabis plant material of the present disclosure is of the species *Cannabis sativa*. The cannabis plant is also commonly known as hemp. Hemp typically denotes varieties of cannabis plants that are cultivated for non-drug use. Hemp often has low levels of tetrahydrocannabinol (THC), such as less then 0.3% THC by dry weight (commonly referred to as "industrial hemp").

In an embodiment, the cannabis plant material used in the methods and products of the present disclosure is from freshly grown cannabis plants of the species *Cannabis sativa*. In an embodiment, the cannabis plant material used in the methods of the present disclosure is hemp. In an embodiment, the cannabis plant material used in the methods of the present disclosure is discarded cannabis plant material from a producer (e.g. licensed producer) of cannabinoid products.

The plant material that is used in the methods and products of the present disclosure may be any suitable component of the plant. Broadly and without limitation, the components of plants having bast and hurd fibers may include roots, stems, branches, leaves, nodes, buds, and seeds. Bast fibers and hurd fibers however are generally found in the stalks, stems and branches of the plants. Bast fibers are fibers extracted from the skin of the stalks, stems and branches of the plants, while hurd fibers are shorter fibers extracted from the core of the stalks, stems and branches. In an embodiment, the plant material used in the methods and products of the present disclosure is the stalks, stems and/or branches of the plant. However, other components of the plants may also be used if so desired.

Where the methods herein involve a step of providing a plant bast fiber material, a plant hurd fiber material, and optionally a xylem material, it is intended to mean that these materials are provided as separated components. For example, the individual components may have been previously separated from the plant material by any suitable process, such as for example a decorticating step that removes the more exterior bast fiber material from the inner core comprising the hurd fibers. As will be appreciated, it possible that the bast fiber material may include a small proportion of hurd fibers. Likewise, the hurd fiber material may include a small proportion of bast fibers. It is not intended by referring to "a bast fiber material" and "a hurd fiber material" herein that the respective material will be 100% pure as separation techniques cannot necessarily provide that level of accuracy in separation. Also, it is contemplated that one or both of the materials may include other plant components, such as for example xylem material.

Where the methods herein involve a step of mechanical refining, the mechanical refining may be performed by any suitable means. In an embodiment, the mechanical refining may be an atmospheric mechanical refining. As used herein, "atmospheric refining" or "atmospheric mechanical refining", used interchangeably herein, refers to a mechanical refining in which plant material is ground and/or crushed to separate fibers therefrom under atmospheric conditions—i.e. at ambient or normal pressure and temperature. By this, it is meant that the plant material is not heated or cooled and is not in a pressurized vessel or in a vessel under reduced pressure. Typical conditions for ambient or normal pressure and temperature are about 1 atm (14.7 psi) and room temperature (e.g. about 20° C.). Atmospheric mechanical refining is an advantageous process in that it is capable of providing high consistency refining.

In other embodiments, the mechanical refining may be a process of thermomechanical pulping, whereby the mechanical refining is performed in the presence of steam and under pressurized conditions, for example in a thermomechanical pulping refiner using pressurized steam. In other embodiments, the mechanical refining is performed in the presence of steam, but under normal pressure (e.g. 1 atm; 14.7 psi). In other embodiments, the mechanical refining is performed under pressurized conditions (e.g. in a pressure vessel) or under reduced pressure (e.g. <1 atm), but without steam.

In any of the conditions described herein, the mechanical refining may be any technique, apparatus or system that is capable of breaking the plant material down into individual or small bundles of fibers, preferably individual fibers. For example, this may be accomplished by an apparatus in which the plant material is ground and/or crushed between opposing plates. The plates may be customized plates for the mechanical refining of plant material having bast and hurd fibers. In a particular embodiment, the plates may be customized plates for the mechanical refining of cannabis plant material. The mechanical refining may occur in a single step (e.g. single refiner) or in a series of steps (e.g. sequential refiners). The plant material may be passed through the refiner(s) any number of times, for example one, two, three, four, five or more times. The mechanical refining may include one or more screening steps employing screens to capture plant material that should be subjected to further mechanical refining.

In embodiments of the methods herein, it was found advantageous to combine atmospheric mechanical refining with a pre-treatment step involving oxygen delignification for processing plant hurd fiber material. A high quality pulp was obtained and the processing costs were reduced by not using heat. In further embodiments, the pre-treatment may be or include a chemical pre-treatment, such as for example with a citric acid solution.

In embodiments of the methods herein, the mechanical refining may be performed at one time or at various times throughout the processing of the plant bast fiber material and/or plant hurd fiber material. In some embodiments, the mechanical refining may be performed as a separate and distinct processing step, whereas in other embodiments a mechanical refining may be performed together with one or more other processing steps. For example, in some embodiments of the methods herein, a mechanical refining may be performed before, during or after a steam treatment, a chemical treatment, or a steam and pressure treatment. In other embodiments, the mechanical refining is a single or series or distinct steps absent from any steam, pressure or chemical treatment. In an embodiment of the methods herein, where two or more applications of mechanical refining are performed, the separate stages of mechanical refining may be performed in the same manner (e.g. both atmospheric mechanical refining) or in a different manner (e.g. one is atmospheric and the other is thermomechanical).

Where the methods herein involve a step of performing a steam and pressure refining, it is intended to refer to a single or series of steps involving treatment of the plant fiber material (e.g. plant bast fiber material) in the presence of steam and under pressurized conditions. In embodiments of the methods of the present disclosure, the treatment involves a chemical treatment in a heated liquid solution. The heated liquid solution may comprise any suitable chemicals for pulping of the plant fiber material (e.g. bast fiber material). In embodiments of the methods of the present disclosure, the steam and pressure refining may include one or more pre-treatments with steam. In some embodiments, one or more of the steam pre-treatments may be under pressurized conditions, but typically the steam pre-treatments are at normal atmospheric pressure. In an embodiment, the steam and pressure refining of the methods herein include 1, 2, 3, 4, 5, or more pre-treatments with steam. In an embodiment, the methods include two pre-treatments with steam, both of which are under normal atmospheric conditions.

In embodiments of the methods of the present disclosure, the steam and pressure refining may include treatments of the plant fiber material (e.g. plant bast fiber material) in one or more heated liquid chemical solutions. The treatments in heated liquid chemical solutions are typically performed in a pressure vessel under pressurized conditions. The treatments in heated liquid chemical solutions may include cooking or boiling the plant fiber material in the liquid chemical solution. In an embodiment, the liquid chemical solution may be a citric acid solution, liquid sulfur dioxide, a sulfuric acid solution, a sodium hydroxide solution, a bicarbonate solution (e.g. sodium bicarbonate or calcium bicarbonate), a carbonate solution (e.g. sodium carbonate or calcium carbonate) solution, a chloride solution (e.g. sodium chloride or calcium chloride), or any combination thereof together or separate, or any chemically equivalent alternative. As used herein, by "together or separate", it is meant that the chemical treatment may be performed in a single solution comprising any combination of chemicals or in separate solutions of each chemical.

In a particular embodiment, the steam and pressure refining may comprise a treatment in a bicarbonate solution or a sodium hydroxide solution. In a particular embodiment, the steam and pressure refining may comprise a pre-treatment in a citric acid solution or an oxygen delignification, followed by a treatment in a sodium bicarbonate solution. In embodiments of the methods herein, it was found advantageous to perform a bicarbonate (e.g. sodium bicarbonate) steam and pressure refining with a citric acid or oxygen delignification pre-treatment for processing plant bast fiber material. A high quality pulp was obtained with very low chemical concentrations, thereby providing a significant reduction in processing costs (e.g. chemical costs).

Referring now to FIG. 1, a flowchart representing an exemplary method of the present disclosure for producing a pulp or paper product from a plant material having bast and hurd fibers is shown and generally identified using the reference numeral 10. The method 10 comprises steps of: providing a decorticated plant material (20), performing a mechanical refining to form a pulp slurry (40), and producing the pulp or paper product from the pulp slurry (80). For ease of reference, the expression "decorticated plant material" is used generally herein to refer to any one or more of the plant materials provided by decortication of a plant material having bast and hurd fibers. For example, the term may refer individually to the plant bast fiber material, the plant hurd fiber material, the xylem, or to any combination thereof. Thus, the method 10 may comprise steps of: providing one or both of a plant bast fiber material and a plant hurd fiber material, and optionally a xylem material (20), performing a mechanical refining of one or both of the plant bast fiber material and plant hurd fiber material, and optionally the xylem material, to form a pulp slurry (40), and producing the pulp or paper product from the pulp slurry (80).

According to one embodiment, providing 20 of the decorticated plant material may include a step of decorticating raw plant material having bast and hurd fibers. The raw plant material may include plant stems and branches. In some embodiments, decortication may involve removing the plant bast fiber material and the plant xylem to separate those components from the inner plant hurd fiber material. In some embodiments, decortication may involve removing the plant bast fiber material to separate it from the inner plant hurd fiber material and the xylem. The decorticating may further comprise separating the xylem into its own component, separate from either the plant bast fiber material or the plant hurd fiber material.

In an embodiment of method 10, providing 20 of the decorticated plant material involves providing both the plant bast fiber material and the plant hurd fiber material for processing in the method 10. In an embodiment of method 10, providing 20 of the decorticated plant material involves providing only the plant bast fiber material for processing in the method 10. In an embodiment of method 10, providing 20 of the decorticated plant material involves providing only the plant hurd fiber material for processing in the method 10.

As used herein, "plant bast fiber material" refers to the plant biomass derived from or comprised substantially of bast fibers. As described above, bast fibers are typically found in the skin of the stems and branches of the plants. In an embodiment, the plant bast fiber material may include the outermost components of the stem or branches, such as any epidermis or cortex. In other embodiments, the epidermis and/or cortex may be substantially removed during decortication to obtain a more pure plant bast fiber material. Xylem is used to transport water from the roots to the rest of the plant and is found further inwards towards the core of the stems and branches. As used herein, "plant hurd fiber material" refers to the plant biomass derived from or comprised substantially of hurd fibers. Hurd fibers are typically found in the core the plants. Indeed, hurd is sometimes referred to as "core" or "shive". Thus, in one embodiment, decorticating the plant material comprises separating the plant material into its bast, hurd and optionally xylem components.

The decortication of the plant material having bast and hurd fibers may be completed using any suitable technique. In small scale operations, the decortication may be performed by hand or small-scale equipment. In large or commercial scale operations, the decortication may be performed by industrial-scale equipment, such as for example and without limitation a Cretes 1 ton decorticator machine (Cretes, Belgium), a hammermill, or a bladed system (e.g. a HempTrain™ decorticator).

In an embodiment, the decorticating step includes cutting the plant bast fiber material and/or the plant hurd fiber material to a particular length. The cutting may be by any suitable device or apparatus. In a non-limiting embodiment, a Pierret cutting machine may be used (Pierret, Belgium). In an embodiment, the plant bast fiber material and the plant hurd fiber material are cut to a length of between about 1 cm and about 10 cm, more particularly between about 1 cm and about 7 cm, more particularly still between about 1 cm and about 5 cm, and even more particularly between about 1 cm and about 3 cm. In an embodiment, the plant bast fiber material and the plant hurd fiber material are cut to a length of about 1 cm, about 2 cm, about 3 cm, about 4 cm, about 5 cm, about 6 cm, about 7 cm, about 8 cm, about 9 cm, or about 10 cm. In a particular embodiment, the plant bast fiber material and the plant hurd fiber material are cut to a length of between about 1 cm and about 3 cm, for example about 1 cm, about 1.5 cm, about 2 cm, about 2.5 cm, or about 3 cm. The plant bast fiber material and the plant hurd fiber material may be cut to the same length or to a different length. In certain embodiments, even shorter lengths may be used (e.g. between about 25 mm and 100 mm in length).

After decortication, plant hurd fibers and bast fibers may, independently, have a length of between about 1 cm and about 10 cm, and a thickness of between about 0.1 mm and about 5 cm, more particularly between about 0.1 mm and about 5 mm. In an embodiment, bast fibers may have a length of between about 1 cm and about 7 cm and hurd fibers may have a length of between about 1 cm and about 3 cm. In an embodiment, hurd fibers may have a length of 5 cm, while plant bast fibers may have a length of about 10 cm. In an embodiment, hurd fibers may have a length of 3 cm, while plant bast fibers may have a length of about 7 cm. In an embodiment, hurd fibers may have a length of 1 cm, while plant bast fibers may have a length of about 5 cm. Again, as above, even shorter lengths may be produced and used in the methods herein.

In some embodiments, the method 10 of the present disclosure may further comprise washing and screening of the decorticated plant material (30). The washing and screening 30 may remove contaminants such as residual soil, fertilizer, pests (e.g. insects), and the like, as well as screen for appropriately decorticated plant material for continuing in the process. The washing and screening 30 may be performed using water and any suitable industrial screening equipment, respectively. Any decorticated material that does not pass the screening may be discarded, used for other applications, or subjected to further decortication.

As described above, the method 10 of the present disclosure comprises performing a mechanical refining to form a pulp slurry (40). The performing 40 of the mechanical refining grinds and crushes the decorticated cannabis plant material to isolate fibrous material (e.g. hurd fibers and/or bast fibers) therefrom. The performing 40 of the mechanical refining may be done using any suitable mechanical refiner, such as for example a rotating disc refiner which grinds and crushes plant material between two rotating discs. In other embodiments, the mechanical refiner may include opposing plates for crushing and grinding the decorticated plant material therebetween. In other embodiments, the mechanical refiner may include a rolling apparatus for crushing the decorticated plant material. In some embodiments, the mechanical refiners may be modified to be suitable for the methods disclosed herein. For example, the rotating discs may be modified to provide thicker or thinner fibers than provided by standard equipment. In addition, plates of different sizes or having different spacing between them may be used. This may be advantageous in the methods herein for providing higher quality pulping fibers, as opposed to 'roping' the fibers that entangle to create a 'rope'-style fiber. Roping is a significant issue as 'roped' fibers can cause jams in fiber processing machines, and thus reducing roping is advantageous.

In some embodiments, the mechanical refining may be an atmospheric mechanical refining. An atmospheric mechanical refining was found to be advantageous in some embodiments to avoid over-processing of the plant hurd fiber material into a mushy pulp that dried to an unusable cake by a thermomechanical refining.

In an embodiment, prior to the performing 40 of the mechanical refining, the method 10 herein may include a step of pre-treating the decorticated plant material (35). In embodiments that include the washing and screening 30, the pre-treating step 35 may be performed before or after the washing and screening 30. In an embodiment, the pre-treating step 35 is performed after the washing and screening 30. In select embodiments, the methods 10 herein include the pre-treating step 35 when the mechanical refining 40 is an atmospheric mechanical refining.

In an embodiment, the pre-treating step 35 involves subjecting the decorticated plant material (e.g. the plant bast fiber material and/or or the plant hurd fiber material) to an oxygen delignification, a chemical treatment, a steam pre-treatment, or any combination thereof.

The oxygen delignification may be performed by any suitable process. In an embodiment, the oxygen delignification pre-treatment involves heating the decorticated plant material (e.g. plant bast fiber material and/or the plant hurd fiber material) in the presence of $O_2$ in a pressure vessel, such as for example and without limitation in a Jaime Reactor ($O_2$ Delignifier; pressure sealed vacuum vessel). The pressure vessel may be under pressurized conditions and may be flooded with $O_2$ and heated to a temperature between 60° C. and 160° C. to perform the oxygen delignification. In an embodiment, the temperature is about 80° C., about 85° C., about 90° C., about 95° C., about 100° C., about 105° C., or about 110° C. In a particular embodiment, the temperature is about 100° C. The oxygen delignification may be performed for any suitable length of time, and in an embodiment between about 10 minutes and about 90 minutes, more particularly between about 30 minutes and about 60 minutes. In an embodiment, the pre-treating step 35 further comprises subjecting the decorticated plant material to a chemical treatment prior to the oxygen delignification, such as a treatment with sulfur dioxide ($SO_2$), sodium hydroxide (NaOH) or citric acid ($C_6H_8O_7$) or any chemically equivalent alternative. In a particular embodiment, the pre-treating step 35 comprises a step of subjecting the decorticated plant material to sulfur dioxide and then performing the oxygen delignification. In another particular embodiment, the pre-treating step 35 comprises a step of subjecting the decorticated plant material to a citric acid solution and then performing the oxygen delignification.

In some embodiments, the pre-treating step 35 involves subjecting the decorticated plant material to a chemical treatment, but in the absence of the oxygen delignification. The chemical treatment may for example be performed by heating the plant bast fiber material or the plant hurd fiber material in the presence of citric acid ($C_6H_8O_7$), sulfur dioxide ($SO_2$), sulfuric acid ($H_2SO_4$), sodium hydroxide (NAOH), a bicarbonate, e.g. sodium bicarbonate ($NaHCO_3$), calcium bicarbonate $Ca(HCO_3)_2$, or any combination thereof together or separate, or any chemically equivalent alternative.

Any chemical treatment described herein may be under heated conditions, pressurized conditions, or both heated and pressurized conditions. By "heated" or "heating" herein, it is intended to include cooking or boiling the material (e.g. plant bast fiber material or plant hurd fiber material). In certain embodiments, the heating is any temperature above room temperature. In certain embodiments, the heating is between 40° C. and 180° C., more particularly between 80° C. and 160° C., and more particularly still between 100° C. and 160° C. In certain embodiments, the heating is at about 80° C., about 90° C., about 100° C., about 110° C., about 120° C., about 130° C., about 140° C., about 150° C., or about 160° C. In a particular embodiment, the temperature is about 100° C. By "pressurized conditions" herein, it is meant any pressure above normal atmospheric pressure of 1 atm (14.7 psi). Thus, in an embodiment, the pressurized condition is any pressure above 14.7 psi. In an embodiment, the pressurized condition is any pressure between about 14.7 psi and about 300 psi. In an embodiment, the pressurized condition is any pressure between about 14.7 psi and about 100 psi. In an embodiment, the pressurized condition is any pressure between about 25 psi and about 100 psi, more particularly between about 50 psi and about 100 psi, and more particularly still between about 50 psi and about 75 psi.

In some embodiments, the pre-treating step 35 involves subjecting the decorticated plant material to a steam pre-treatment. A steam pre-treatment may be used even when the mechanical refining is an atmospheric mechanical refining, but is most typically employed when a thermomechanical pulping process is employed for mechanical refining of the decorticated plant material (e.g. the plant bast fiber material or the plant hurd fiber material). The steam pre-treatment may be performed under pressurized conditions, but most typically is not. Thus, in an embodiment, the steam pre-treatment is performed under normal pressure, whereas the thermomechanical pulping is performed in the presence of steam and under pressurized conditions, as described elsewhere herein. Such embodiments may use a steam generator to provide steam for both the steam pre-treatment and thermomechanical pulping steps, and additionally may use a steam reclaimer (e.g. cyclone) to separate and reclaim the steam after the mechanical refining.

In an embodiment of method 10, the performing 40 of the mechanical refining is on both the plant bast fiber material and the plant hurd fiber material. In an embodiment of method 10, the performing 40 of the mechanical refining is on only the plant bast fiber material. In an embodiment of method 10, the performing 40 of the mechanical refining is on only the plant hurd fiber material. In select embodiments of the methods disclosed herein, it may be preferred to perform the mechanical refining only on the plant hurd fiber material and to process the plant bast fiber material in a separate processing stream and by a different process.

The method 10 is for producing a pulp product from a plant material having bast and hurd fibers. In an embodiment of the method 10, the plant material is a cannabis, flax, sunn, kenaf, mulberry, or mitsumata plant material. In select embodiments of the method 10, the plant material is a cannabis plant material or a flax plant material. In a particular embodiment of the method 10, the plant material is a cannabis plant material. In a particular embodiment of the method 10, the plant material is hemp.

In some embodiments, the method 10 may be performed using a cannabis plant material (e.g. hemp) and may be in the absence of any other plant material. That is, in such embodiments, only cannabis plant material is refined in the methods 10 of the present disclosure to produce the pulp or paper products. Thus, in a further embodiment the produced pulp or paper product may comprise 100% cannabis plant material. As will be appreciated, because there is no requirement for other biomass sources such as wood, the method 10 of the present disclosure may advantageously avoid the disadvantages associated with the harvesting of such biomass sources, including those previously outlined herein.

Further, as previously described herein, embodiments of the methods 10 of the present disclosure are capable of producing pulp and paper products using significantly less water than conventional wood pulping processes. For example, in some embodiments, the mechanical refining may advantageously be performed without steam, which is generally required to soften wood biomass during such steps.

The methods 10 of the present disclosure include a step of producing 80 the pulp or paper product from the pulp slurry. The producing 80 may comprise one or more steps of washing, dewatering, thickening, forming, drying, cutting, and bailing. In an embodiment, producing 80 the pulp from the pulp slurry may sequentially comprise steps of washing, dewatering, and drying the pulp slurry to form a pulp. In an embodiment, producing 80 the pulp from the pulp slurry may sequentially comprise steps of washing, thickening, forming, drying, cutting and bailing. In an embodiment, producing 80 the paper product from the pulp may be done by a procedure similar to conventional processes for converting wood pulp into a paper product.

In some embodiments of the methods 10, the producing 80 of the pulp or paper product may be directly from the pulp slurry formed by the performing 40 of the mechanical refining as described herein. In some embodiments, further processing steps may be performed to provide the pulp slurry.

For example, in some embodiments, the method 10 of the present disclosure may comprise a step of separating moisture and/or contaminants to obtain the pulp slurry (50). The moisture may be residual moisture contained in the decorticated plant material that has been released by the performing 40 of the mechanical refining on the decorticated plant material. The contaminants may include unwanted plant material such as non-fibrous solid components and non-water liquids (e.g. sap) freed by the mechanical refining. The separating 50 may comprise a cyclone separation. In an embodiment, the separating 50 may comprise a cyclone separation in the absence of steam. Cyclone separations typically involve running a fluid comprising solid particles (e.g. the pulp slurry) into a generally conical tank to form a cyclone therein. The solid particles collide with the walls of the tank and, as a result, fall out of the fluid for collection through a bottom outlet. In the context of the present disclosure, any industrial cyclone separator may be suitable and may be modified as appropriate for the methods disclosed herein.

According to a further embodiment, the method 10 of the present disclosure may further comprise removing latency from the pulp slurry (60). As used herein, "latency" describes the tendency of fibers to curl after refining (e.g. after the mechanical refining). The removing of latency 60 may be effected using a continuous stirred-tank reactor, the centrifugal forces of which remove the latent properties (i.e. the curl) of the fibers. Any industrial continuous stirred-tank reactor or like equipment may be used in the methods of the present disclosure, and may be modified as appropriate for the methods disclosed herein.

In some embodiments, the methods 10 of the present disclosure may further comprise subjecting the pulp slurry to an oxygen delignification (70). As used herein, "oxygen delignification" refers to a process by which lignin is removed from plant matter using gaseous oxygen. During the subjecting 70 of the pulp slurry to oxygen delignification, the pulp slurry may be heated and then exposed to oxygen gas ($O_2$), which acts as an oxidizer to break down the polymeric structure of lignin. In an embodiment, the oxygen delignification is in the presence of a base (e.g. NaOH). Any suitable oxygen delignifier may be used and may be modified as appropriate for use in the methods of the present disclosure.

Oxygen delignification bears considerably less risk to the environment than chemical-based delignification techniques, which generally involve using sodium sulfite baths to break down lignin, as such techniques typically produce volatile sulfides (e.g. hydrogen sulfide, dimethyl sulfide, etc.) that must be captured and processed before their release into the environment. As well, while capturing the volatile sulfide compounds, sulfur dioxide, which is a major air pollutant that has significant impacts on human and animal health, is often produced as an intermediate. While the sulfur dioxide is largely reacted off to produce sodium sulfate crystals, some can escape to the atmosphere during processing (e.g. when pulp and paper plants shut down for maintenance). Oxygen delignification avoids such risks.

Instead, oxygen delignification of plant material having bast and hurd fibers (e.g. cannabis plant material) produces environmentally friendly, sustainable byproducts. In some embodiments, the method 10 comprises capturing a waste stream during the subjecting 70 of the pulp slurry to oxygen delignification. The waste stream may then be subjected to steam generation and steam reclamation to thereby recycle the stream and/or captured for use as a fertilizer for agricultural applications such as growing further plants for subsequent pulping by the methods disclosed herein.

In addition to removing lignin from the pulp slurry, the subjecting 70 of the pulp slurry to oxygen delignification may also brighten the slurry such that the pulp or paper product resulting therefrom may have a brightness of at least about 70. In a further embodiment, the pulp or paper product may have a brightness of between about 80 to about 100, more particularly between about 80 to about 95. As the skilled person will appreciate, "brightness" measures the amount of reflectance of a specific wavelength of blue light (e.g. 457 nm). Brightness is measured on a scale of 0 to 100, whereby the higher the number the brighter the pulp or paper product. In contrast, "whiteness" measures the reflection of all wavelengths of light across the visible spectrum, whereby the higher the whiteness rating (again 0-100 scale), the whiter the paper. In an embodiment, the pulp or paper product produced by the methods herein may have a whiteness of at least about 70. In a further embodiment, the pulp or paper product may have a whiteness of between about 80 to about 100, more particularly between about 80 to about 95. In an embodiment, the pulp or paper product produced by the methods herein may have both a brightness and a whiteness that is greater than 85.

The brightness or colour of the pulp and paper product may also be measured using LAB colour values, i.e. L-star (L*), A-star (a*), and B-star (b*). L* stands for lightness, a* stands for red/green value, and b* stands for blue/yellow value. In an embodiment, the pulp or paper product produced by the methods herein may have an L* of 70 or more, an a* value between −20 and +20, and a b* value of between −20 and +20.

Thus, in some embodiments, the methods of the present disclosure may not involve a step of brightening the pulp slurry. This may be beneficial, as conventional brightening steps may use chlorine as a bleaching agent, which forms environmentally hazardous organochlorine compounds as a by-product. Using oxygen delignification avoids the need for such bleaching agents and therefore the risk of releasing such compounds into the environment.

However, in the event that additional brightening is desired or the step of subjecting the pulp slurry to the oxygen delignification is not performed, the methods of the present disclosure, including the two-stream methods below, may further comprise brightening the pulp slurry. In such embodiments and without limitation, the pulp slurry may be brightened using hydrogen peroxide, which is capable of brightening the slurry without producing environmentally hazardous byproducts such as organochlorides.

Thus, in light of the above, the methods of the present disclosure may be performed without the use of toxic chemicals—i.e. a toxic chemical-free process. It is noted that, by "toxic chemicals" it is meant chemicals that are capable of harming humans, animals, and/or the environment upon exposure thereto. In other embodiments, the methods of the present disclosure may be performed without the use of toxic chemicals in amounts sufficient in the resulting pulp and paper products to be capable of causing harm to humans, animals and/or the environment. As a result, the produced pulp or paper product may be free from such toxic chemicals or free of harmful amounts of such toxic chemicals. In fact, in some embodiments, the pulp or paper product may be edible.

Further, embodiments of the methods of the present disclosure may be performed using significantly fewer resources than conventional pulping processes due at least in part to the minimal amount of processing steps required and because processing steps, such as the mechanical refining may be performed without steam (i.e. by atmospheric mechanical refining). As a result, in some embodiments, the methods of the present disclosure may consume less than about 22,000 L of water to produce about 1 tonne of the pulp or paper product. In another embodiment, the methods of the present disclosure may consume less than about 1 GJ to produce about 1 tonne of the pulp or paper product. As previously discussed herein, such water requirements may be less than about 33% of that of the Kraft wood pulping process and less than about 17% of that of exclusively thermomechanical wood pulping processes, while the energy requirements may be less than about 5% of that of the Kraft process and less than about 10% of that of exclusively thermomechanical wood pulping processes.

The method 10 of the present disclosure is capable of producing a pulp or paper product from a plant material having bast and hurd fibers. Thus, in another aspect, the present disclosure relates to a pulp or paper product produced by the method 10 of the present disclosure. As described herein, in an embodiment, the pulp or paper product is toxic chemical-free and/or is biodegradable.

In an embodiment, the pulp or paper product consists essentially of a cannabis, flax, sunn, kenaf, mulberry, or mitsumata plant material. In this context, by "consists essentially of", it is meant that the pulp material of the pulp or paper product comes exclusively from these plants having bast and hurd fiber materials. Pulp from a different plant or tree, such as a softwood or hardwood lumber, is not present in the pulp or paper products of the present disclosure that consist essentially of a cannabis, flax, sunn, kenaf, mulberry, or mitsumata plant material. However, the expression "consists essentially of" does not preclude the inclusion of other materials or chemicals, residual or purposefully added, which may be present in the pulp and paper products of the present disclosure. For example and without limitation, the pulp or paper products may include non-wood filler materials and/or residual chemicals from the methods disclosed herein.

In some embodiments, the pulp or paper product comprises at least 90% w/w, at least 95% w/w, at least 96% w/w, at least 97% w/w, at least 99% w/w, at least 99.5% w/w, at least 99.8% w/w, or at least 99.9% w/w of a cannabis, flax, sunn, kenaf, mulberry, or mitsumata plant material. In such embodiments, the pulp or paper products may for example include non-wood filler materials and/or residual chemicals from the methods disclosed herein for the remaining weight percent up to 100%. In a particular embodiment, the pulp or paper product comprises at least 90% w/w, at least 95% w/w, at least 96% w/w, at least 97% w/w, at least 99% w/w, at least 99.5% w/w, at least 99.8% w/w, or at least 99.9% w/w of a cannabis plant material, such as for example hemp.

In some embodiments, the pulp or paper product comprises 100% w/w of a cannabis, flax, sunn, kenaf, mulberry, or mitsumata plant material. In such embodiments, the pulp or paper product may still include some residual material or chemicals from the methods herein, but it is below the limit of detection using conventional devices. In a particular embodiment, the pulp or paper product comprises 100% w/w of a cannabis plant material, such as for example hemp.

In an embodiment in which the pulp or paper product may be produced by the method 10 of the present disclosure, pulp or paper product may comprise the plant bast fiber material in the absence of any plant hurd fiber material. In such embodiments, the methods 10 of the present disclosure may have involved only the processing of plant bast fiber material.

In another embodiment in which the pulp or paper product may be produced by the method 10 of the present disclosure, pulp or paper product may comprise the plant hurd fiber material in the absence of any plant bast fiber material. In such embodiments, the methods 10 of the present disclosure may have involved only the processing of plant hurd fiber material.

In an embodiment, the pulp or paper product may comprise between about 99:1 and about 99:1 of hurd fiber pulp:bast fiber pulp, more particularly between about 10:1 and 1:10, more particularly still between about 5:1 and 1:5, and even still more particularly between about 1:1 and about 1:5. In an embodiment, the ratio of hurd fiber pulp:bast fiber pulp is between about 5:1 and about 1:25, more particularly between about 1:1 and 1:10, and more particularly still between about 1:1 and 1:5. In an embodiment, the pulp or paper product may comprise a ratio of hurd fiber pulp:bast fiber pulp of about 5:1, about 4:1, about 3:1, about 2:1, about 1:1, about 1:2, about 1:3, about 1:4, about 1:5, about 1:6, about 1:7, about 1:8, about 1:9, about 1:10, about 1:15, about 1:20, about 1:25, about 1:30, about 1:40, about 1:50, about 1:60, about 1:70, about 1:80, about 1:90, about 1:95, or about 1:99. In a particular embodiment, the ratio of hurd fiber pulp:bast fiber pulp in the pulp or paper product is about 1:1, about 1:1.5, about 1:2, about 1:2.5, about 1:3, about 1:3.5, about 1:4, about 1:4.5, or about 1:5. In an embodiment, the ratio is determined on a volume/volume (v/v) basis. In an embodiment, the ratio is determined on a weight/weight (w/w) basis.

The pulp or paper product may comprise any suitable amount of the hurd fiber pulp and the bast fiber pulp. In an embodiment, the pulp or paper product comprises between about 20% v/v to about 80% v/v of the hurd fiber pulp. In an embodiment, the pulp or paper product comprises about 20% v/v, about 25% v/v, about 30% v/v, about 35% v/v, about 40% v/v, about 45% v/v, about 50% v/v, about 55% v/v, about 60% v/v, about 65% v/v, about 70% v/v, about 75% v/v, or about 80% v/v of the hurd fiber pulp. In an embodiment, the pulp or paper product comprises at least 25% v/v, at least 50% v/v, or at least 75% v/v of the hurd fiber pulp. In any of the preceding embodiments, the pulp or paper product may be brought up to 100% with the bast fiber pulp. In an embodiment, the pulp or paper product comprises between about 20% v/v to about 80% v/v of the bast fiber pulp. In an embodiment, the pulp or paper product comprises about 20% v/v, about 25% v/v, about 30% v/v, about 35% v/v, about 40% v/v, about 45% v/v, about 50% v/v, about 55% v/v, about 60% v/v, about 65% v/v, about 70% v/v, about 75% v/v, or about 80% v/v of the bast fiber pulp. In an embodiment, the pulp or paper product comprises at least 25% v/v, at least 50% v/v, or at least 75% v/v of the bast fiber pulp. In an embodiment, the pulp or paper product comprises about 70% v/v of bast fiber pulp and about 30% v/v of hurd fiber pulp.

The brightness or colour of the pulp or paper product is described elsewhere herein. In an embodiment, the pulp or paper product has a brightness of at least about 70, at least about 80, at least about 90, or higher. In an embodiment, the pulp or paper product has a brightness of between about 80 to about 90.

In an embodiment, the pulp or paper product of the present disclosure is a repro paper (e.g. commercial print paper, office paper, etc.), newsprint paper, paperboard, cardboard, or fine art paper.

As described elsewhere herein, Northern bleached softwood kraft (NBSK) is the paper industry's benchmark grade of pulp. In an embodiment, the pulp or paper product of the present disclosure is of a quality equivalent to Northern bleached softwood kraft or higher.

As described elsewhere herein, advantageously in some embodiments the present disclosure relates to a two-stream process for producing the pulp and paper products, whereby the plant bast fiber material is processed separately and by a different process than the plant hurd fiber material. Herein, the term "stream" is used to describe a processing procedure that is distinct and separate from a different stream. In an embodiment, the plant hurd fiber material is processed in a "first stream" and the plant bast fiber material is processed in a "second stream". The terms "first" and "second" are to denote that the streams are separate and distinct, and is not intended to mean that one stream is performed before the other or imply and sequence of processing as between the streams. Although the underlying and primary pulping procedure in each stream is separate and different (e.g. mechanical refining versus chemical pulping), there may be some processing steps within each stream that are performed in the same or similar manner (e.g. pre-treatment steps, oxygen delignification steps, washing and screening steps, latency removal, etc.) or are even performed together (e.g. decortication, etc.).

By "two-stream" herein, it is meant to refer to separate processing streams for the plant bast fiber material and the plant hurd fiber material. In certain embodiments, the methods herein may include additional processing streams, such as for example a processing stream involving a recycled material for producing pulp or paper products of the present disclosure that further comprise a recycled material.

In an exemplary embodiment of a two-stream method of the present disclosure, the method comprises:

processing of a plant hurd fiber material into a hurd fiber pulp or pulp slurry in a first stream;

processing of a plant bast fiber material into a bast fiber pulp or pulp slurry in a second stream;

blending of the hurd fiber pulp or pulp slurry and the bast fiber pulp or pulp slurry to provide a blended pulp or pulp slurry; and producing the pulp or the paper product from the blended pulp or pulp slurry, wherein the first stream and the second stream are performed separate from each other.

As such, in an embodiment of the present disclosure, different types of plant fiber material (bast versus hurd) may be separated, independently processed, and recombined to produce a blended pulp slurry from which the pulp or paper product may be produced. For example, as described above, providing the decorticated plant material comprises in some embodiments decorticating a plant material having bast and hurd fibers to remove plant bast fiber material and optionally xylem therefrom, and provide a plant hurd fiber material. The plant bast fiber material may then be processed separately from the plant hurd fiber material, each in a separate processing stream and by a different procedure.

Various different procedures for processing the plant bast fiber material and the plant hurd fiber material may be used, so long as each is processed by a different pulping procedure and then blended to form the blended pulp. Without limitation, in an embodiment the pulping procedures that may be used in either the first stream (hurd fiber) or the second stream (bast fiber) include a mechanical refining, a thermomechanical refining, a steam and pressure refining, a steam and pressure refining with chemical pulping (e.g. a Kraft process or a modified Kraft process), chemical pulping in the absence of steam and/or pressure, or any combination thereof so long as the pulping procedure used in the first stream is different than that used in the second stream. In an embodiment, the first stream (hurd fiber) or the second stream (bast fiber) uses a mechanical refining (thermomechanical, atmospheric mechanical, or a combination thereof) and the other stream uses a steam and pressure refining with chemical pulping (e.g. a Kraft process or a modified Kraft process).

Herein, it was found advantageous in producing a high quality pulp in a cost efficient and effective manner, to use a mechanical refining procedure on the plant hurd fiber material and a steam and pressure refining (with chemical treatment) on the plant bast fiber material. Advantageously, it was further found that the economics of these procedures could be improved and a high quality pulp product obtained by modifying these procedures or processing streams as described herein (e.g. by including an oxygen delignification or chemical pre-treatment).

Thus, in an embodiment, the plant hurd fiber material may be subjected to a mechanical refining in a first stream to produce a plant hurd fiber pulp or pulp slurry. The mechanical refining may be any suitable form of mechanical refining, including for example thermomechanical refining, atmospheric mechanical refining, or any combination thereof. The mechanical refining of the plant hurd fiber material in the first stream of the two-stream methods herein may be performed as described elsewhere herein in respect of performing the mechanical refining 40 in the method 10 of the present disclosure.

In an embodiment, the plant bast fiber material may be subjected to a steam and pressure refining in a second stream to produce a plant bast fiber pulp or pulp slurry. The steam and pressure refining herein may, for example, embody a process similar to a Kraft process, and in particular a low-chemical Kraft process which was found advantageous herein (e.g. with oxygen delignification pre-treatment).

Thus, in a further embodiment, an exemplary two-stream method of the present disclosure comprises the steps of:

decorticating a plant material having bast and hurd fibers to separate and provide a plant bast fiber material and a plant hurd fiber material;

performing a mechanical refining of the plant hurd fiber material in a first stream to form a hurd fiber pulp or pulp slurry;

performing a steam and pressure refining of the plant bast fiber material in a second stream to form a bast fiber pulp or pulp slurry;

blending the bast fiber pulp or pulp slurry and the hurd fiber pulp or pulp slurry to form a blended pulp or pulp slurry; and producing the pulp or the paper product from the blended pulp or pulp slurry.

The decorticating in the two-steam methods herein may be performed as described elsewhere herein. In an embodiment, the decorticating includes a step of cutting the plant bast fiber material and plant hurd fiber material to lengths as described herein. In an embodiment, the plant bast fiber material and plant hurd fiber material are each independently cut to a length between about 1 cm and about 7 cm. In an embodiment, the plant bast fiber material and plant hurd fiber material are each independently cut to a length between about 1 cm and about 3 cm.

In an embodiment, the mechanical refining of the plant hurd fiber material in the first stream is an atmospheric mechanical refining. An atmospheric mechanical refining was found to be advantageous in some embodiments to avoid over-processing of the hurd fibers into a mushy pulp that dried to an unusable cake by a thermomechanical refining.

The mechanical refining of the plant hurd fiber material may be performed by any suitable procedure or machinery, including for example those described herein in respect of performing the mechanical refining 40 in the method 10 of the present disclosure. The mechanical refining grinds and crushes the plant hurd fiber material to isolate fibrous material therefrom. In an embodiment, the mechanical refining is performed using a rotating discs, opposing plates, rollers, or any combination thereof. In an embodiment, for performing an atmospheric refining an Andritz Thermomechanical Mill may be modified to the thermo components. In an embodiment, customized grinding plates for the plant hurd fiber material may then be used in the modified Andritz mill, for example plates having a customized plate thickness for processing hurd fibers.

In an embodiment, the mechanical refining of the plant hurd fiber material in the first stream comprises a pre-treatment by an oxygen delignification (first stream oxygen delignification), by a chemical treatment, or by steam (each of which is described elsewhere herein). In a particular embodiment of the two-stream methods disclosed herein, the pre-treatment of the plant hurd fiber material is by a first stream oxygen delignification.

The first stream oxygen delignification may be performed by any suitable process. In an embodiment, the first stream oxygen delignification involves heating the plant hurd fiber material in the presence of $O_2$ in a pressure vessel, such as for example and without limitation in a Jaime Reactor ($O_2$ Delignifier; pressure sealed vacuum vessel). The pressure vessel may be under pressurized conditions and may be flooded with $O_2$ and heated to a temperature between 60° C. and 160° C. to perform the oxygen delignification. In a particular embodiment, the temperature is about 100° C. The oxygen delignification may be performed for any suitable length of time, and in an embodiment about 30 minutes.

In an embodiment, the plant hurd fiber material may be subjected to a chemical treatment prior to the first stream oxygen delignification, such as a treatment with sulfur dioxide ($SO_2$), sodium hydroxide (NaOH) or citric acid ($C_6H_8O_7$) or any chemically equivalent alternative. In an embodiment, the plant hurd fiber material is subjected to a pre-treatment with liquid sulfur dioxide prior to the first stream oxygen delignification. In an embodiment, the plant hurd fiber material is subjected to a pre-treatment with citric acid prior to the first stream oxygen delignification.

In another embodiment of the two-stream methods disclosed herein, the plant hurd fiber material is subjected to a chemical pre-treatment prior to the mechanical refining, without oxygen delignification. The chemical treatment may for example be performed by heating the plant hurd fiber material in the presence of citric acid ($C_6H_8O_7$), sulfur dioxide ($SO_2$), sulfuric acid ($H_2SO_4$), sodium hydroxide (NAOH), a bicarbonate, e.g. sodium bicarbonate ($NaHCO_3$), calcium bicarbonate $Ca(HCO_3)_2$, or any combination thereof together or separate, or any chemically equivalent alternative. In an embodiment, the chemical treatment comprises heating the plant hurd material in a citric acid solution followed by heating the plant hurd material in a bicarbonate solution. The chemical pre-treatment may be under steam and/or pressure conditions, or not. In an embodiment, the chemical treatment is in a pressure vessel under pressurized conditions.

In the two-stream methods herein, the plant bast fiber material is subjected to a steam and pressure refining in a second stream. By "steam and pressure refining", it is meant to refer to a single or series of steps involving treatment of the plant bast fiber material in the presence of steam and/or under pressurized conditions.

In embodiments of the two-stream methods herein, the steam and pressure refining includes one or more chemical treatments of the plant bast fiber material in a heated liquid solution, also referred to herein as chemical pulping. The heated liquid solution may comprise any suitable chemicals for pulping of the plant fiber material, such as for example chemicals used in a Kraft-style pulping procedure.

In embodiments of the two-stream methods, the treatments in heated liquid chemical solutions are performed in a pressure vessel under pressurized conditions. The treatments in heated liquid chemical solutions may include cooking or boiling the plant fiber material in the liquid chemical solution. In an embodiment, the liquid chemical solution may be a citric acid solution, liquid sulfur dioxide, a sulfuric acid solution, a sodium hydroxide solution, a bicarbonate solution (e.g. sodium bicarbonate or calcium bicarbonate), a carbonate solution (e.g. sodium carbonate or calcium carbonate) solution, a chloride solution (e.g. sodium chloride or calcium chloride), or any combination thereof together or separate, or any chemically equivalent alternative.

In embodiments of the two-stream methods, the steam and pressure refining may include one or more pre-treatments of the plant hurd fiber material with steam. The steam pre-treatments may be under pressurized conditions, but typically the steam pre-treatments are at normal atmospheric pressure. In an embodiment, the plant bast fiber material undergoes at least 1, at least 2, at least 3, at least 4, or at least 5 pre-treatments with steam in the second stream. In an embodiment, the plant bast fiber material undergoes two pre-treatments with steam in the second stream, both of which are under normal atmospheric conditions.

In embodiments of the two-stream methods, the plant bast fiber material may be subjected to a pre-treatment by an oxygen delignification (second stream oxygen delignification) or by a chemical treatment. The second stream oxygen delignification may be performed in a similar fashion as described herein for the first stream oxygen delignification. Likewise, the chemical pre-treatment in the second stream may be the same as the embodiments described for the chemical treatment in the first stream.

In a particular embodiment of the two-stream methods disclosed herein, the plant bast fiber material is subjected to a second stream oxygen delignification. In an embodiment, the second stream oxygen delignification comprises heating the plant bast fiber material in the presence of $O_2$ in a pressure vessel. In an embodiment, the second stream includes a step of treating the plant hurd fiber material with sulfur dioxide, sodium hydroxide or citric acid prior to the first stream oxygen delignification. In a particular embodiment, with citric acid.

In respect of processing plant bast fiber material in accordance with the two-stream methods herein, advantageously it has been found that a reduced chemical pulping procedure can be employed when a pre-treatment is performed by either a chemical pre-treatment or an oxygen delignification. For example, in embodiments of the methods herein, it was found advantageous to perform a bicarbonate (e.g. sodium bicarbonate) steam and pressure refining with a citric acid or oxygen delignification pre-treatment for processing plant bast fiber material. A high quality pulp was obtained with very low chemical concentrations, thereby providing a significant reduction in processing costs (e.g. chemical costs).

Thus, in an embodiment, the steam and pressure refining in the second stream comprises one or more steps of chemical pulping comprising heating the plant bast material in a citric acid solution followed by heating the plant hurd material in a bicarbonate solution (e.g. sodium bicarbonate), both under steam and pressure conditions. In another embodiment, the steam and pressure refining in the second stream comprises an oxygen delignification followed by heating the plant hurd material in a bicarbonate solution (e.g. sodium bicarbonate) under steam and pressure conditions.

In one or both of the first stream and the second stream, a step of separating moisture and/or contaminants may be performed, for example after the mechanical refining (hurd fiber) and the steam and pressure refining (bast fiber). The separating of the water from the plant bast fiber material may remove water introduced to the plant bast fiber material from steam that condensed during the steam and pressure refining, or during any pre-treatment steps. The separating of the water from the plant hurd fiber material may remove any residual moisture contained in the plant hurd fiber material that was freed during the mechanical refining or that was introduced during processing (e.g. during the pre-treatment steps). In some embodiments, the separating of the water comprises a cyclone separation. The cyclone separation may be completed in the same or similar manner as previously described herein, but in an exemplary embodiment is performed in the presence of steam in the second stream for processing the bast fiber material, whereas the processing of the hurd fiber material is preferably performed in the absence of steam. In a further embodiment, the water may be reclaimed and used to generate steam that may then be used in the pre-treatment and/or steam and pressure refining steps, thereby reducing the water requirements of the methods of the present disclosure.

In an embodiment, one or both of the first stream and the second stream may comprise a step of washing and screening the plant bast fiber material and/or plant hurd fiber material. In an embodiment, the washing and screening may be performed after decorticating the plant material, and prior to the mechanical refining of the plant hurd fiber material and the steam and pressure refining of the plant bast fiber material. In some embodiments, the first and second streams further comprise a step of removing latency from the plant bast fiber pulp or pulp slurry and/or the plant hurd fiber pulp or pulp slurry. The washing and screening and the latency removal, in the context of the two-stream methods, may be performed in the same or similar manner as the steps 30 and 60, respectively, previously described herein in respect of the method 10 of the present disclosure.

Thus, in an embodiment of the two-stream methods herein, the first stream processing of the plant hurd fiber material may comprise the sequential steps of: (i) performing a hurd pre-treatment step by a chemical treatment or an oxygen delignification; (ii) washing and screening the plant hurd fiber material; (iii) performing the mechanical refining; (iv) performing a cyclone separation in the absence of steam; and (v) removing latency and/or screening to form the hurd fiber pulp or pulp slurry.

Alternatively, in another embodiment, the first stream processing of the plant hurd fiber material may comprise the sequential steps of: (i) washing and screening the plant hurd fiber material; (ii) performing a hurd pre-treatment step by a chemical treatment or an oxygen delignification; (iii) performing the mechanical refining; (iv) performing a cyclone separation in the absence of steam; and (v) removing latency and/or screening to form the hurd fiber pulp or pulp slurry.

Alternatively, in another embodiment, the first stream processing of the plant hurd fiber material may comprise the sequential steps of: (i) washing and screening the plant hurd fiber material; (ii) performing the mechanical refining; (iii) performing a cyclone separation in the absence of steam; and (iv) removing latency and/or screening to form the hurd fiber pulp or pulp slurry.

Alternatively, in another embodiment, the first stream processing of the plant hurd fiber material may comprise the sequential steps of: (i) performing a hurd pre-treatment step by a chemical treatment or an oxygen delignification, (ii) performing the mechanical refining; (iii) performing a cyclone separation in the absence of steam; and (iv) removing latency and/or screening to form the hurd fiber pulp or pulp slurry.

With respect to the second stream, in an embodiment of the two-stream methods herein the second stream processing of the plant bast fiber material may comprise the sequential steps of: (i) performing a bast pre-treatment step by a chemical treatment or an oxygen delignification; (ii) washing and screening the plant bast fiber material; (iii) pre-treating the washed plant bast fiber material with steam; (iv) performing the steam and pressure refining; (v) performing a steam separation step in a cyclone to remove the steam from the steam and pressure refining; and (vi) removing latency and/or screening to form the bast fiber pulp or pulp slurry.

Alternatively, in another embodiment, the second stream processing of the plant bast fiber material may comprise the sequential steps of: (i) washing and screening the plant bast fiber material; (ii) performing a bast pre-treatment step by a chemical treatment or an oxygen delignification; (iii) pre-treating the plant bast fiber material with steam; (iv) performing the steam and pressure refining; (v) performing a steam separation step in a cyclone to remove the steam from the steam and pressure refining; and (vi) removing latency and/or screening to form the bast fiber pulp or pulp slurry.

Alternatively, in another embodiment, the second stream processing of the plant bast fiber material may comprise the sequential steps of: (i) washing and screening the plant bast fiber material; (ii) performing a bast pre-treatment step by a chemical treatment or an oxygen delignification; (iii) performing the steam and pressure refining; (iv) performing a steam separation step in a cyclone to remove the steam from the steam and pressure refining; and (v) removing latency and/or screening to form the bast fiber pulp or pulp slurry.

Alternatively, in another embodiment, the second stream processing of the plant bast fiber material may comprise the sequential steps of: (i) washing and screening the plant bast fiber material; (ii) pre-treating the plant bast fiber material with steam; (iii) performing the steam and pressure refining; (iv) performing a steam separation step in a cyclone to remove the steam from the steam and pressure refining; and (v) removing latency and/or screening to form the bast fiber pulp or pulp slurry.

The methods of the present disclosure provide a hurd fiber pulp or pulp and a bast fiber pulp or pulp slurry for subsequent refining into the pulp or paper product. By "hurd fiber pulp or pulp slurry", it is meant a pulp or pulp slurry that is comprised substantially of plant hurd fibers. By "comprised substantially of plant hurd fibers", it is meant that the hurd fiber pulp or pulp slurry may comprise plant material other than hurd fibers, but if any bast fibers are present in the hurd pulp or pulp slurry it is only a minor component (e.g. less than 5% w/w, less than 4% w/w, less than 3% w/w, less than 2% w/w, less than 1% w/w, less than 0.5% w/w, less than 0.25% w/w, less than 0.1% w/w, or even less). By "bast fiber pulp or pulp slurry", it is meant a pulp or pulp slurry that is comprised substantially of plant bast fibers. By "comprised substantially of plant bast fibers", it is meant that the bast fiber pulp or pulp slurry may comprise plant material other than bast fibers, but if any hurd fibers are present in the bast pulp or pulp slurry it is only a minor component (e.g. less than 5% w/w, less than 4% w/w, less than 3% w/w, less than 2% w/w, less than 1% w/w, less than 0.5% w/w, less than 0.25% w/w, less than 0.1% w/w, or even less).

As indicated above, once produced, the bast fiber pulp or pulp slurry and the hurd fiber pulp or pulp slurry may be blended to form a blended pulp or pulp slurry from which the pulp or paper product may be produced. The bast fiber pulp or pulp slurry and the hurd fiber pulp or pulp slurry may be blended by any suitable procedure using any suitable machine, and may be blended at any predefined ratio.

In an embodiment, the blending of the hurd fiber pulp or pulp slurry and the bast fiber pulp or pulp slurry is performed in a blend chest. As used herein, the term "blend chest" refers to any container, open or closed, into which the hurd fiber pulp or pulp slurry and the bast fiber pulp or pulp slurry can be placed to be mixed or blended together. In an embodiment, the blend chest is capable of mixing the hurd fiber pulp or pulp slurry and the bast fiber pulp or pulp slurry to form a substantially homogeneous mixture of the two. By "substantially homogenous mixture", it is meant to refer to a generally uniform dispersion of the hurd fiber pulp or pulp slurry and the bast fiber pulp or pulp slurry within the blended pulp or pulp slurry.

In an embodiment, the blend chest is a vessel (e.g. container) which can be pressurized for mixing of the hurd fiber pulp or pulp slurry and the bast fiber pulp or pulp slurry. In an embodiment, only a light pressurization is applied to the blend chest. Recycle mills typically use blend chests to mix high quality new or fresh pulp with a lower quality recycled pulp to make a substantially homogeneous 'recycled' pulp product.

In an embodiment, the step of blending the hurd fiber pulp or pulp slurry and the bast fiber pulp or pulp slurry may include a step of washing and drying within the blend chest.

In an embodiment, the step of blending the hurd fiber pulp or pulp slurry and the bast fiber pulp or pulp slurry may include a step of applying sulfur dioxide to produce the blended pulp or pulp slurry. In some embodiments, the hurd fiber pulp or pulp slurry and/or the bast fiber pulp or pulp slurry may retain a higher than desired concentration of cellulose or hemicellulose. The higher concentrations of cellulose and/or hemicellulose may cause the pulp to be more rigid than desired, and thereby rending the blended pulp or pulp slurry less workable. The application of small quantities of sulfur dioxide during blending can reduce this undesired characteristic.

In an embodiment, the step of blending the hurd fiber pulp or pulp slurry and the bast fiber pulp or pulp slurry is performed in the absence of light and under mild pressure conditions. Blend chests create a conducive environment for such reaction conditions, whereby stronger bonds between any dye and the blended pulp or pulp slurry can occur. Thus, in an embodiment, the step of blending the hurd fiber pulp or pulp slurry and the bast fiber pulp or pulp slurry includes a step of applying one or more dyes for dying the blended pulp or pulp slurry.

As above, the hurd fiber pulp or pulp slurry and the bast fiber pulp or pulp slurry may be blended at a predefined ratio. The predefined ratio between the bast fiber pulp or pulp slurry and the hurd fiber pulp or pulp slurry may be any suitable ratio based on characteristics of the starting plant material and resultant pulp (e.g. based on cellulose or hemicellulose content). For example, an optimal amount of each of the bast fiber pulp or pulp slurry and hurd fiber pulp or pulp slurry for blending, and thereby the predefined ratio therebetween in the blended pulp, may differ based on growth conditions of the plants (e.g. yearly variance, species variance, location, crop type—e.g. dry versus irrigated, etc.), which for example may impact the cellulose, hemicellulose and lignin content and thereby alter the predefined fiber ratios.

In an embodiment, the blended pulp slurry may comprise a predefined ratio of between about 99:1 and about 99:1 of hurd fiber pulp or pulp slurry:bast fiber pulp or pulp slurry, more particularly between about 10:1 and 1:10, more particularly still between about 5:1 and 1:5, and even still more particularly between about 1:1 and about 1:5. In an embodiment, the predefined ratio of hurd fiber pulp or pulp slurry: bast fiber pulp or pulp slurry is between about 5:1 and about 1:25, more particularly between about 1:1 and 1:10, and more particularly still between about 1:1 and 1:5. In an embodiment, the blended pulp slurry may comprise a ratio of hurd fiber pulp or pulp slurry:bast fiber pulp or pulp slurry of about 5:1, about 4:1, about 3:1, about 2:1, about 1:1, about 1:2, about 1:3, about 1:4, about 1:5, about 1:6, about 1:7, about 1:8, about 1:9, about 1:10, about 1:15, about 1:20, about 1:25, about 1:30, about 1:40, about 1:50, about 1:60, about 1:70, about 1:80, about 1:90, about 1:95, or about 1:99. In a particular embodiment, predefined ratio of hurd fiber pulp or pulp slurry:bast fiber pulp or pulp slurry is about 1:1, about 1:1.5, about 1:2, about 1:2.5, about 1:3, about 1:3.5, about 1:4, about 1:4.5, or about 1:5. In an embodiment, the predefined ratio is determined on a volume/volume (v/v) basis. In an embodiment, the predefined ratio is determined on a weight/weight (w/w) basis.

The blended pulp or pulp slurry may comprise any suitable amount of the hurd fiber pulp or pulp slurry and the bast fiber pulp or pulp slurry to produce a quality pulp or paper product. In an embodiment, the blended pulp or pulp slurry comprises between about 20% v/v to about 80% v/v of the hurd fiber pulp slurry, and is brought up to 100% with the bast fiber pulp or pulp slurry. In an embodiment, the blended pulp or pulp slurry comprises about 20% v/v, about 25% v/v, about 30% v/v, about 35% v/v, about 40% v/v, about 45% v/v, about 50% v/v, about 55% v/v, about 60% v/v, about 65% v/v, about 70% v/v, about 75% v/v, or about 80% v/v of the hurd fiber pulp or pulp slurry. In an embodiment, the blended pulp or pulp slurry comprises at least 25% v/v, at least 50% v/v, or at least 75% v/v of the hurd fiber pulp or pulp slurry. In any of the preceding embodiments, the blended pulp or pulp slurry may be brought up to 100% with the bast fiber pulp or pulp slurry or with the bast fiber pulp or pulp slurry and any other suitable pulping ingredients or components. In an embodiment, the blended pulp or pulp slurry comprises about 80% v/v, about 75% v/v, about 70% v/v, about 65% v/v, about 60% v/v, about 55% v/v, about 50% v/v, about 45% v/v, about 40% v/v, about 35% v/v, about 30% v/v, about 25% v/v, or about 20% v/v of the bast fiber pulp or pulp slurry. In a particular embodiment, the blended pulp or pulp slurry may comprise about 30% v/v of the hurd fiber pulp or pulp slurry and about 70% v/v of the bast fiber pulp or pulp slurry.

The two-stream methods of the present disclosure are for producing a pulp product from a plant material having bast and hurd fibers. In an embodiment of the two-stream methods, the plant material is a cannabis, flax, sunn, kenaf, mulberry, or mitsumata plant material. In select embodiments of the two-stream methods, the plant material is a cannabis plant material or a flax plant material. In a particular embodiment of the two-stream methods, the plant material is a cannabis plant material. In a particular embodiment of the two-stream methods, the plant material is hemp.

In some embodiments, the two-stream methods may be performed using a cannabis plant material (e.g. hemp) and may be in the absence of any other plant material. That is, in such embodiments, only cannabis plant material is refined in the two-stream methods of the present disclosure to produce the pulp or paper products. Thus, in a further embodiment the produced pulp or paper product may comprise 100% cannabis plant material. As will be appreciated, because there is no requirement for other biomass sources such as wood, the two-stream methods of the present disclosure may advantageously avoid the disadvantages associated with the harvesting of such biomass sources, including those previously outlined herein.

The blended pulp slurry formed from blending the bast fiber pulp or pulp slurry and the hurd fiber pulp or pulp slurry may be subsequently processed in the same or similar manner as outlined above (e.g. subjection to oxygen delignification, latency screening, etc.) to produce the pulp or paper product.

In an embodiment of the two-stream methods, producing the pulp or paper product from the blended pulp or pulp slurry may comprise one or more steps of washing, dewatering, thickening, forming, drying, cutting, and bailing. In an embodiment, producing the pulp from the blended pulp or pulp slurry may sequentially comprise steps of washing, dewatering, and drying the pulp slurry to form a pulp. In an embodiment, producing the pulp from the blended pulp or pulp slurry may sequentially comprise steps of washing, thickening, forming, drying, cutting and bailing. In an embodiment, producing the paper product from the pulp may be done by a procedure similar to conventional processes for converting wood pulp into a paper product.

In some embodiments of the two-stream methods, the producing of the pulp or paper product may be directly from the blended pulp or pulp slurry. In some embodiments, further processing steps may be performed to provide the pulp slurry. In an embodiment, the blended pulp or pulp slurry is subjected to an oxygen delignification. In an embodiment, the blended pulp or pulp slurry is subjected to a latency screening. In an embodiment, the blended pulp or pulp slurry is sequentially subjected to an oxygen delignification and a latency screening.

Figure 2:
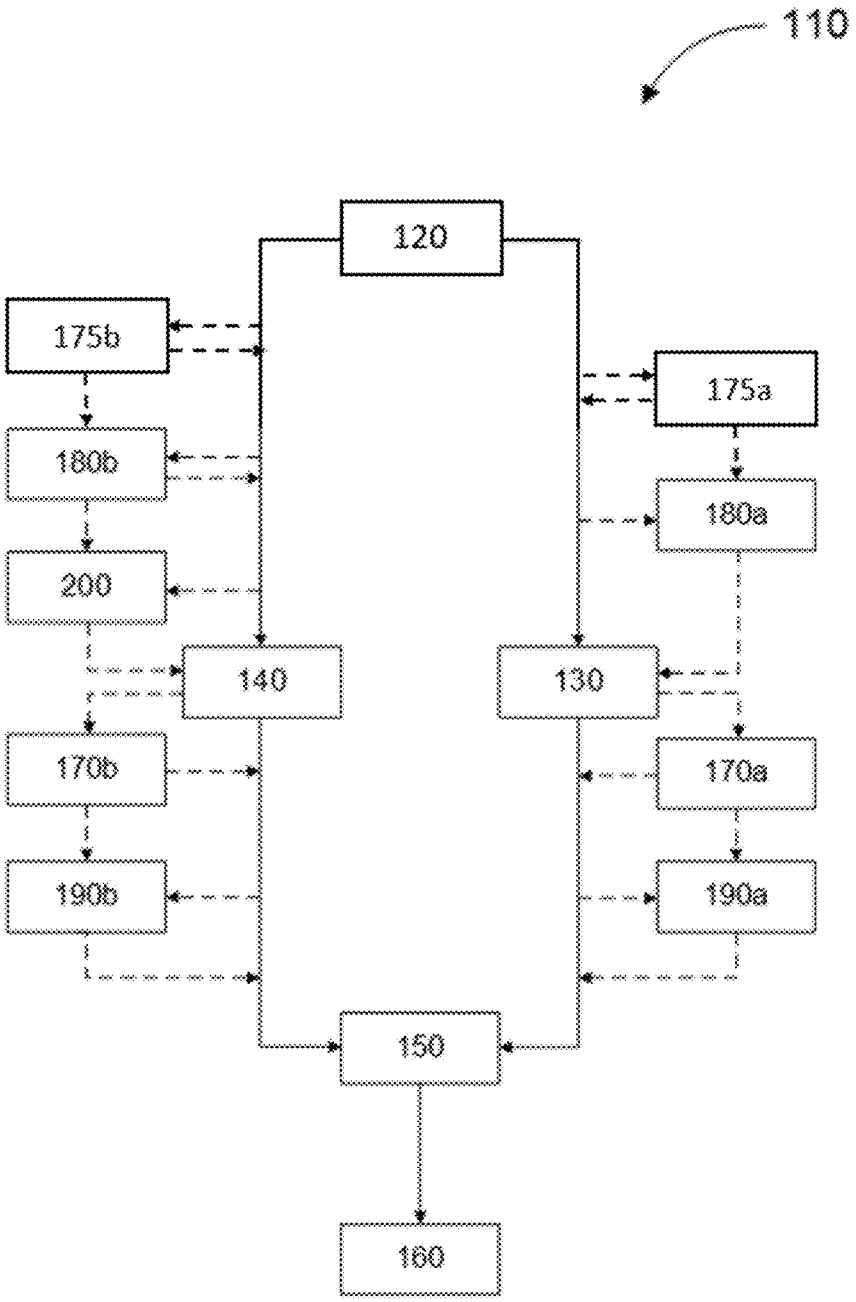
FIG. 2 shows a flowchart representing a method for producing a pulp or paper product from a cannabis plant material according to another embodiment of the present disclosure, wherein broken arrows represent exemplary embodiments.

For greater clarity, FIG. 2 shows a flowchart representing an exemplary two-stream method of the present disclosure for producing a pulp or paper product from a plant material having bast and hurd fibers. As shown in FIG. 2, the method involves producing and blending plant bast fiber and hurd fiber pulp or pulp slurries. The two-stream method is generally identified using the reference numeral 110.

As shown in FIG. 2, the method 110 may comprise steps of: decorticating a plant material having bast and hurd fibers to separate and provide both a plant bast fiber material and a plant hurd fiber material (120); performing a mechanical refining of the plant hurd fiber material to form a hurd fiber pulp or pulp slurry (130); performing a steam and pressure refining of the plant bast fiber material to form a bast fiber pulp or pulp slurry (140); blending the bast fiber pulp or pulp slurry and the hurd fiber pulp or pulp slurry to form a blended pulp or pulp slurry (150); and producing the pulp or the paper product from the blended pulp or pulp slurry (160).

As discussed above, in an embodiment, the method 110 may further comprise a cyclone separation in the absence of steam (170*a*), following the mechanical refining 130, to provide the hurd fiber pulp or pulp slurry. The method 110 may also include one or more additional steps to process and/or produce the hurd fiber pulp or pulp slurry. For example, in some embodiments, the forming of the hurd fiber pulp or pulp slurry comprises steps of: subjecting the plant hurd fiber material to a pre-treatment step, such as a chemical treatment and/or an oxygen delignification (175*a*); washing and screening the plant hurd fiber material (180*a*), performing 130 the mechanical refining, performing 170*a* the cyclone separation in the absence of steam; and removing latency and screening to form the hurd fiber pulp slurry (190*a*). As described above, each of the steps 130, 170*a*, 175*a*, 180*a*, and 190*a* may be performed in the same or similar manner previously described herein in respect to the method 10.

Furthermore, also as described above, in an embodiment, the method 110 may further comprise a cyclone separation (170*b*) to remove the steam from the plant bast fiber material after the steam and pressure refining 140 of the plant bast fiber material. It is noted that the difference between the cyclone separation 170*a* and the cyclone separation 170*b* is that the cyclone separation 170*b* is not necessarily performed in the absence of steam. As well, the method 110 may also include one or more additional steps to process and/or produce the bast fiber pulp or pulp slurry. For example, in some embodiments, forming the bast fiber pulp or pulp slurry comprises steps of: subjecting the plant bast fiber material to a pre-treatment step, such as a chemical treatment and/or an oxygen delignification (175*b*); washing and screening the plant bast fiber material (180*b*), pretreating the washed plant bast fiber material with steam (200); performing 140 the steam and pressure refining; performing 170*b* a cyclone separation to remove the steam; and removing latency and screening to form the bast fiber pulp or pulp slurry (190*b*). It is noted that each of the steps 140, 170*b*, 175*b*, 180*b*, 190*b*, and 200, may be performed as previously described herein.

While some embodiments of the present disclosure involve the use of a steam and pressure refining to produce a plant bast fiber pulp or pulp slurry (e.g. the embodiment illustrated in FIG. 2), such embodiments still afford a number of advantages. For example, in some embodiments, steam and pressure refining of the plant bast fiber material may be completed using only water and/or mild chemicals and does not require the use of toxic chemicals. As well, plant bast fibers generally make up a minority of raw plant material. As a result, there is generally less plant bast fiber material to process than, for example, wood-derived material used in conventional Kraft wood pulping processes. Moreover, in some embodiments of the present disclosure, only a minor component of the blended pulp or pulp slurry may be derived from the bast fiber pulp or pulp slurry, and therefore the use of steam and pressure refining processes may be minimal in respect of these products. Even in embodiments in which the blended pulp or pulp slurry contains a larger quantity of bast fiber pulp or pulp slurry than hurd fiber pulp or pulp slurry, due to the inclusion of hurd fiber material in the blended product less material is being processed by steam and pressure refining than would be for a pulp exclusively made from bast fiber material. Thus, the energy requirements and water usage may be significantly less than those required for the Kraft processing of wood.

The present disclosure also relates to pulp or paper products produced by the methods described therein. The pulp or paper product may be any of those previously described herein.

In a particular embodiment, the pulp or paper product may be produced by the two-stream methods of the present disclosure. Thus, in another aspect, the present disclosure relates to a pulp or paper product produced by the two-stream methods of the present disclosure. As described herein, in an embodiment, the pulp or paper product is toxic chemical-free and/or is biodegradable.

In an embodiment, the pulp or paper product consists essentially of a cannabis, flax, sunn, kenaf, mulberry, or mitsumata plant material. In this context, by "consists essentially of", it is meant that the pulp material of the pulp or paper product comes exclusively from these plants having bast and hurd fiber materials. Pulp from a different plant or tree, such as a softwood or hardwood lumber, is not present in the pulp or paper products of the present disclosure which consist essentially of a cannabis, flax, sunn, kenaf, mulberry, or mitsumata plant material. However, the expression "consists essentially of" does not preclude the inclusion of other materials or chemicals, residual or purposefully added, which may be present in the pulp and paper products of the present disclosure. For example and without limitation, the pulp or paper products may include non-wood filler materials and/or residual chemicals from the methods disclosed herein.

In some embodiments, the pulp or paper product comprises at least 90% w/w, at least 95% w/w, at least 96% w/w, at least 97% w/w, at least 99% w/w, at least 99.5% w/w, at least 99.8% w/w, or at least 99.9% w/w of a cannabis, flax, sunn, kenaf, mulberry, or mitsumata plant material. In such embodiments, the pulp or paper products may for example include non-wood filler materials and/or residual chemicals from the methods disclosed herein for the remaining weight percent up to 100%. In a particular embodiment, the pulp or paper product comprises at least 90% w/w, at least 95% w/w, at least 96% w/w, at least 97% w/w, at least 99% w/w, at least 99.5% w/w, at least 99.8% w/w, or at least 99.9% w/w of a cannabis plant material, such as for example hemp.

In some embodiments, the pulp or paper product comprises 100% w/w of a cannabis, flax, sunn, kenaf, mulberry, or mitsumata plant material. In such embodiments, the pulp or paper product may still include some residual material or chemicals from the methods herein, but it is below the limit of detection using conventional devices. In a particular embodiment, the pulp or paper product comprises 100% w/w of a cannabis plant material, such as for example hemp.

In an embodiment, the pulp or paper product may comprise between about 99:1 and about 99:1 of hurd fiber pulp:bast fiber pulp, more particularly between about 10:1 and 1:10, more particularly still between about 5:1 and 1:5, and even still more particularly between about 1:1 and about 1:5. In an embodiment, the ratio of hurd fiber pulp:bast fiber pulp is between about 5:1 and about 1:25, more particularly between about 1:1 and 1:10, and more particularly still between about 1:1 and 1:5. In an embodiment, the pulp or paper product may comprise a ratio of hurd fiber pulp:bast fiber pulp of about 5:1, about 4:1, about 3:1, about 2:1, about 1:1, about 1:2, about 1:3, about 1:4, about 1:5, about 1:6, about 1:7, about 1:8, about 1:9, about 1:10, about 1:15, about 1:20, about 1:25, about 1:30, about 1:40, about 1:50, about 1:60, about 1:70, about 1:80, about 1:90, about 1:95, or about 1:99. In a particular embodiment, the ratio of hurd fiber pulp:bast fiber pulp in the pulp or paper product is about 1:1, about 1:1.5, about 1:2, about 1:2.5, about 1:3, about 1:3.5, about 1:4, about 1:4.5, or about 1:5. In an embodiment, the ratio is determined on a volume/volume (v/v) basis. In an embodiment, the ratio is determined on a weight/weight (w/w) basis.

The pulp or paper product may comprise any suitable amount of the hurd fiber pulp and the bast fiber pulp. In an embodiment, the pulp or paper product comprises between about 20% v/v to about 80% v/v of the hurd fiber pulp. In an embodiment, the pulp or paper product comprises about 20% v/v, about 25% v/v, about 30% v/v, about 35% v/v, about 40% v/v, about 45% v/v, about 50% v/v, about 55% v/v, about 60% v/v, about 65% v/v, about 70% v/v, about 75% v/v, or about 80% v/v of the hurd fiber pulp. In an embodiment, the pulp or paper product comprises at least 25% v/v, at least 50% v/v, or at least 75% v/v of the hurd fiber pulp. In any of the preceding embodiments, the pulp or paper product may be brought up to 100% with the bast fiber pulp. In an embodiment, the pulp or paper product comprises between about 20% v/v to about 80% v/v of the bast fiber pulp. In an embodiment, the pulp or paper product comprises about 20% v/v, about 25% v/v, about 30% v/v, about 35% v/v, about 40% v/v, about 45% v/v, about 50% v/v, about 55% v/v, about 60% v/v, about 65% v/v, about 70% v/v, about 75% v/v, or about 80% v/v of the bast fiber pulp. In an embodiment, the pulp or paper product comprises at least 25% v/v, at least 50% v/v, or at least 75% v/v of the bast fiber pulp. In an embodiment, the pulp or paper product comprises about 70% v/v of bast fiber pulp and about 30% v/v of hurd fiber pulp.

The brightness or colour of the pulp or paper product is described elsewhere herein. In an embodiment, the pulp or paper product has a brightness of at least about 70, at least about 80, at least about 90, or higher. In an embodiment, the pulp or paper product has a brightness of between about 80 to about 90.

In an embodiment, the pulp or paper product of the present disclosure is a repro paper (e.g. commercial print paper, office paper, etc.), newsprint paper, paperboard, cardboard, or fine art paper.

As described elsewhere herein, Northern bleached softwood kraft (NBSK) is the paper industry's benchmark grade of pulp. In an embodiment, the pulp or paper product of the present disclosure is of a quality equivalent to Northern bleached softwood kraft or higher.

In other aspects of the present disclosure, there is provided a cannabis pulp or paper product that consists essentially of cannabis plant material and has a ratio of between 5:1 and 1:5 of hurd fiber pulp:bast fiber pulp.

In this context, by "consists essentially of", it is meant that the pulp material of the cannabis pulp or paper product comes exclusively from a cannabis plant. Pulp from a different plant or tree, such as a softwood or hardwood lumber, is not present in the cannabis pulp or paper product. However, the expression "consists essentially of" does not preclude the inclusion of other materials or chemicals, residual or purposefully added, which may be present in the cannabis pulp and paper products of the present disclosure. For example and without limitation, the cannabis pulp or paper products may include non-wood filler materials and/or residual chemicals from the methods disclosed herein.

In some embodiments, the cannabis pulp or paper product comprises at least 90% w/w, at least 95% w/w, at least 96% w/w, at least 97% w/w, at least 99% w/w, at least 99.5% w/w, at least 99.8% w/w, or at least 99.9% w/w of cannabis plant material. In such embodiments, the cannabis pulp or paper products may for example include non-wood filler materials and/or residual chemicals from the methods disclosed herein for the remaining weight percent up to 100%.

In some embodiments, the cannabis pulp or paper product comprises 100% w/w of cannabis plant material. In such embodiments, the pulp or paper product may still include some residual material or chemicals from the methods herein, but it is below the limit of detection using conventional devices.

In an embodiment, the cannabis pulp or paper product may comprise between about 99:1 and about 99:1 of cannabis hurd fiber pulp:cannabis bast fiber pulp, more particularly between about 10:1 and 1:10, more particularly still between about 5:1 and 1:5, and even still more particularly between about 1:1 and about 1:5. In an embodiment, the ratio of cannabis hurd fiber pulp:cannabis bast fiber pulp is between about 5:1 and about 1:25, more particularly between about 1:1 and 1:10, and more particularly still between about 1:1 and 1:5. In an embodiment, the cannabis pulp or paper product may comprise a ratio of cannabis hurd fiber pulp:cannabis bast fiber pulp of about 5:1, about 4:1, about 3:1, about 2:1, about 1:1, about 1:2, about 1:3, about 1:4, about 1:5, about 1:6, about 1:7, about 1:8, about 1:9, about 1:10, about 1:15, about 1:20, about 1:25, about 1:30, about 1:40, about 1:50, about 1:60, about 1:70, about 1:80, about 1:90, about 1:95, or about 1:99. In a particular embodiment, the ratio of cannabis hurd fiber pulp:cannabis bast fiber pulp in the pulp or paper product is about 1:1, about 1:1.5, about 1:2, about 1:2.5, about 1:3, about 1:3.5, about 1:4, about 1:4.5, or about 1:5. In an embodiment, the ratio is determined on a volume/volume (v/v) basis. In an embodiment, the ratio is determined on a weight/weight (w/w) basis.

The cannabis pulp or paper product may comprise any suitable amount of the cannabis hurd fiber pulp and the cannabis bast fiber pulp. In an embodiment, the cannabis pulp or paper product comprises between about 20% v/v to about 80% v/v of the cannabis hurd fiber pulp. In an embodiment, the cannabis pulp or paper product comprises about 20% v/v, about 25% v/v, about 30% v/v, about 35% v/v, about 40% v/v, about 45% v/v, about 50% v/v, about 55% v/v, about 60% v/v, about 65% v/v, about 70% v/v, about 75% v/v, or about 80% v/v of the cannabis hurd fiber pulp. In an embodiment, the cannabis pulp or paper product comprises at least 25% v/v, at least 50% v/v, or at least 75% v/v of the cannabis hurd fiber pulp. In any of the preceding embodiments, the cannabis pulp or paper product may be brought up to 100% with the cannabis bast fiber pulp. In an embodiment, the cannabis pulp or paper product comprises between about 20% v/v to about 80% v/v of the cannabis bast fiber pulp. In an embodiment, the cannabis pulp or paper product comprises about 20% v/v, about 25% v/v, about 30% v/v, about 35% v/v, about 40% v/v, about 45% v/v, about 50% v/v, about 55% v/v, about 60% v/v, about 65% v/v, about 70% v/v, about 75% v/v, or about 80% v/v of the cannabis bast fiber pulp. In an embodiment, the cannabis pulp or paper product comprises at least 25% v/v, at least 50% v/v, or at least 75% v/v of the cannabis bast fiber pulp. In an embodiment, the cannabis pulp or paper product comprises about 70% v/v of cannabis bast fiber pulp and about 30% v/v of cannabis hurd fiber pulp.

The brightness or colour of pulp or paper products is described elsewhere herein. In an embodiment, the cannabis pulp or paper product has a brightness of at least about 70, at least about 80, at least about 90, or higher. In an embodiment, the cannabis pulp or paper product has a brightness of between about 80 to about 90.

In an embodiment, the cannabis pulp or paper product of the present disclosure is a repro paper (e.g. commercial print paper, office paper, etc.), newsprint paper, paperboard, cardboard, or fine art paper.

As described elsewhere herein, Northern bleached softwood kraft (NBSK) is the paper industry's benchmark grade of pulp. In an embodiment, the cannabis pulp or paper product of the present disclosure is of a quality equivalent to Northern bleached softwood kraft or higher.

In an embodiment, the cannabis pulp or paper product of the present disclosure is a hemp pulp or paper product.

The plant pulp or paper products of the present disclosure may afford a number of advantages. For one, in some embodiments, the plant pulp or paper products may be toxic chemical-free and biodegradable. As described above, the methods to produce the plant pulp or paper products do not require the use of toxic chemicals and may be performed using only water and, optionally, mild chemical, oxygen and/or hydrogen peroxide. In contrast, pulp and paper products produced using conventional wood pulping processes often contain the residual amounts of the chemicals used during manufacturing, a significant amount of which are toxic to humans. For another, the plant pulp or paper products may be recycled up to seven times or more before the particles are too fine for further recycling toxic chemical-free and biodegradable, whereas paper products made from wood typically can only be recycled about three times before becoming useless.

Further, as previously described herein, conventionally, cannabis plant material has been added merely as filler to wood pulp or paper products. However, the plant pulp and paper products of the present disclosure may be produced entirely from plant materials having bast and hurd fibers and thus comprise 100% w/w thereof (e.g. cannabis plant material). As well, in some embodiments, the paper product may be of a quality that is equivalent to or of higher quality than Northern bleached softwood kraft (NBSK). As the skilled person will appreciate, NBSK is the paper industry's benchmark grade of pulp. Thus, by using only plant material having bast and hurd fibers, the pulp and paper products are considerably more environmentally sustainable than those produced from wood without sacrificing the quality of the resulting products. For example, as discussed above, it takes about 1/20 of the time from planting to harvest to 100 tonnes of useable biomass of cannabis plant material as compared to 100 tonnes of useable biomass of wood. This means that cannabis plant material can be readily replenished to produce pulp and paper products therefrom, whereas in order to maintain continuous production of pulp and paper products from wood sources, additional acres of forests need to be harvested while previously-harvested forests are allowed to regrow.

Furthermore, with regards to environmental sustainability, because plant material having bast and hurd fibers as disclosed herein may surprisingly be used to produce pulp or paper products without the use of environmentally hazardous materials, the pulp and paper products bear significantly less risk of damage to the environment than those produced by conventional wood pulping processes.

In the present disclosure, all terms referred to in singular form are meant to encompass plural forms of the same. Likewise, all terms referred to in plural form are meant to encompass singular forms of the same. Unless defined otherwise, all technical and scientific terms used herein have the same meaning as commonly understood by one of ordinary skill in the art to which this disclosure pertains.

EXAMPLES

Example 1

A sample of cannabis plant material (hemp) was obtained and decorticated to separate the plant material into its bast fiber and hurd fiber components. Both the bast fiber (10 g; 95% purity) and hurd fiber (10 g; 100% purity) materials were added to a citric acid solution (500 g/4 L; pH 2.4) and boiled in a pressure vessel for about 1 hour (i.e. under steam and pressure). The bast fiber and hurd fiber materials were then removed from the citric acid solution, washed and transferred to a bicarbonate solution (500 g/4 L; pH 6.86) and boiled in a pressure vessel for about 2 hours (i.e. under steam and pressure). The bast and hurd fiber materials were removed and subjected to mechanical refining by crushing and grinding. The bast/hurd biomass was then washed and boiled in a hydrogen peroxide solution for about 2 hours. The bast/hurd biomass was then removed, washed and left to dry for at least 24 hours.

This single stream method yielded a successful hurd pulp, but rendered the bast into fine particulate material that was brittle (fell apart under touch). Thus, although a pulp slurry was produced, its characteristics were not ideal for various further applications.

In other single stream processing methods, adjustments were made to the process using both cannabis and flax plant materials. However, it was found that the method inevitably resulted in over-processing of either the bast fiber component or the hurd fiber component. Although a pulp was obtained with the bast fiber and/or hurd fiber, the characteristics and profile of the bast/hurd pulp as a whole was not ideal for various further applications. Through further experimentation, it was determined that a two stream process, where each of the bast fiber and hurd fiber were processed in two separate processing streams, would be advantageous in providing a commercially and financially viable bast/hurd pulp.

Example 2

This example describes separate processing of the bast fiber material by different exemplary approaches.

A sample of cannabis plant material (hemp) was obtained and decorticated to separate the plant material into its bast fiber and hurd fiber components. The bast fiber material was used in this example.

Trial 2A: The bast fiber was processed by a chemical (bicarbonate) process with steam and pressure. Bast fiber (10 g; 95% purity) was added to a citric acid solution (256 g/4 L; pH 2.4) and boiled in a pressure vessel for about 2 hours (i.e. under steam and pressure). The bast fiber was then removed from the citric acid solution, washed and transferred to a bicarbonate solution (256 g/4 L; pH 6.86) and boiled in a pressure vessel for about 2 hours (i.e. under steam and pressure). The bast fiber was washed and left to dry for at least 24 hours to provide a bast fiber pulp.

Figure 3:
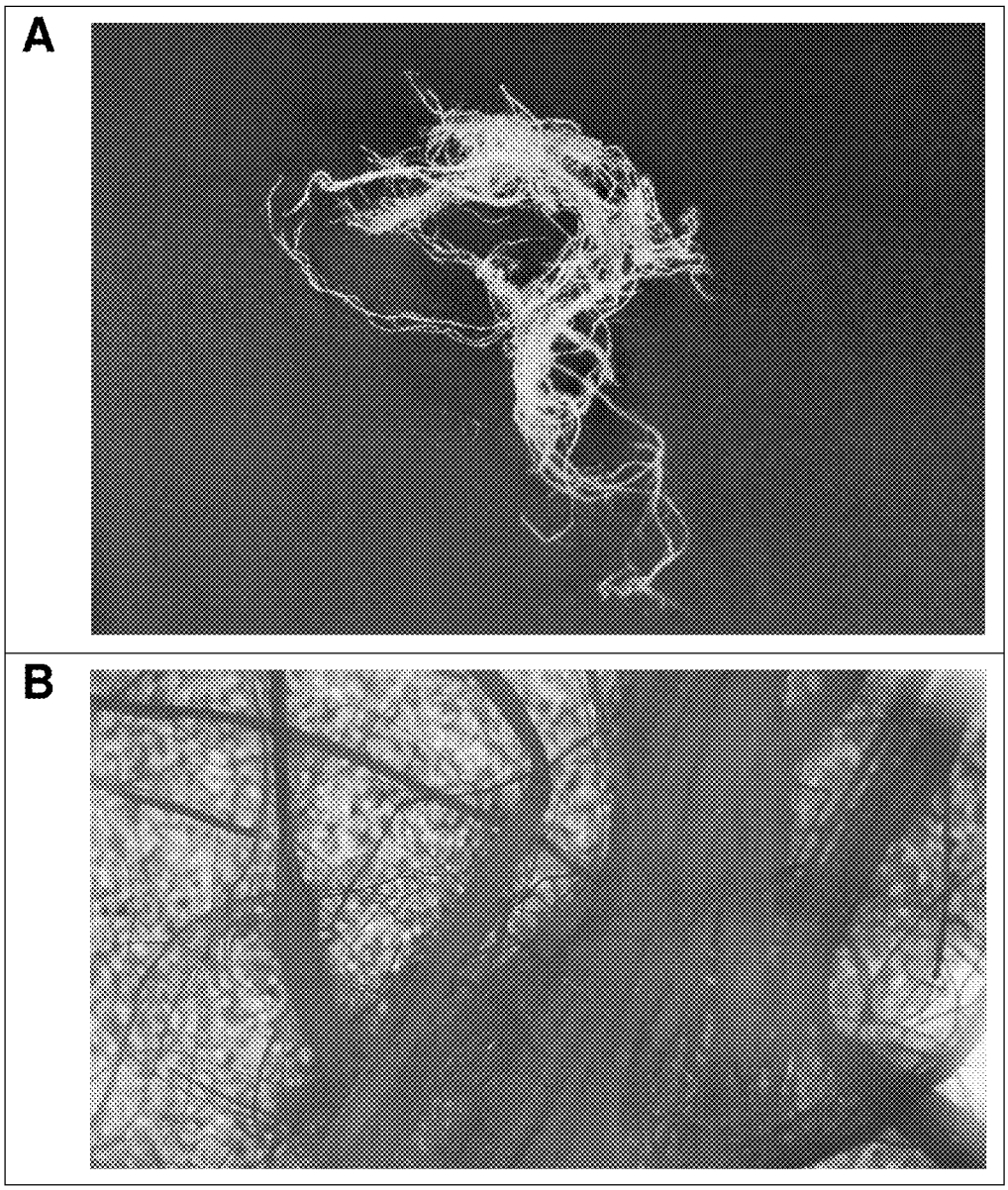
FIG. 3 shows a photographic image (panel A) and a microscopic image (panel B) of an exemplary bast fiber pulp prepared in accordance with methods of the present disclosure.

Trial 2B: The bast fiber was processed by a 20% reduced chemical (bicarbonate) process with steam and pressure. Bast fiber (10 g; 95% purity) was added to a citric acid solution (204 g/4 L; pH 2.4) and boiled in a pressure vessel for about 1 hour (i.e. under steam and pressure). The bast fiber was then removed from the citric acid solution, washed and transferred to a bicarbonate solution (204 g/4 L; pH 6.86) where it was boiled in a pressure vessel for about 2 hours (i.e. under steam and pressure). The bast fiber was then removed, washed and placed in a hydrogen peroxide solution and boiled for about 2 hours. The bast fiber was washed and left to dry for at least 24 hours to provide a bast fiber pulp. A representative image of the bast fiber pulp prepared by this procedure is shown in FIG. 3 (panel A) and a microscopic image (10× magnification) is shown in FIG. 3 (panel B).

Trial 2C: The bast fiber was processed by a chemical (bicarbonate) process with steam and pressure, but with an oxygen delignification pre-treatment. The bast fiber was cut to 5-7 cm in length. Bast fiber material was washed, run through a water tumbler, rinsed and dried (retaining up to 10% moisture). Bast fiber (100 g) was treated with about 5 ml of sulfur dioxide. The bast fiber was then placed into a Jaime Reactor ($O_2$ Delignifier; pressure sealed vacuum vessel), flooded with pure oxygen and heated to about 100° C. for about 30 minutes. The vessel was allowed to cool, and the bast fiber was removed and washed. Bast fiber was then transferred to a bicarbonate solution (30 g/1 L; pH 6.86) for about 2 hours with heating (e.g. 100° C.) under pressure in a pressure vessel. The bast fiber was allowed to cool, washed and then left to dry to provide a bast fiber pulp.

Each of the procedures in this example were capable of preparing a suitable bast fiber pulp to be used in a blended bast/hurd pulp. The bast fiber was a soft fibrous pulp with good fiber length. There was no roping or slushing of the bast fiber in the produced bast fiber pulp.

Example 3

This example describes the separate processing of the hurd fiber material by different exemplary approaches.

A sample of cannabis plant material (hemp) was obtained and decorticated to separate the plant material into its bast fiber and hurd fiber components. The hurd fiber material was used in this example.

Trial 3A: The hurd fiber was processed by a mechanical refining subsequent to a chemical pre-treatment. Hurd fiber (10 g; 100% purity) was added to a citric acid solution (256 g/4 L; pH 2.4) and boiled in a pressure vessel for about 1 hour (i.e. under steam and pressure). The hurd fiber was then removed from the citric acid solution, washed and transferred to a bicarbonate solution (256 g/4 L; pH 6.86) and boiled in a pressure vessel for about 2 hours (i.e. under steam and pressure). The resulting hurd fiber was then mechanically pulled using a manual grinder to form a hurd fiber pulp.

Trial 3B: The hurd fiber was processed by an atmospheric mechanical refining process. The hurd fiber was cut to 5-7 cm in length. Material was washed, run through a water tumbler, rinsed and dried (retaining up to 10% moisture). About 100 g of hurd fiber was treated with about 5 ml of sulfur dioxide. The hurd fiber was then placed into a Jaime Reactor ($O_2$ Delignifier; pressure sealed vacuum vessel), flooded with pure oxygen and heated to about 100° C. for about 30 minutes. The vessel was allowed to cool, and the hurd fiber was removed and washed. Hurd fiber was then subject to mechanical refining (without heat) in a mechanical mill that was modified with custom grinding plates for processing hemp hurd biomass to form a hurd fiber pulp.

Example 4

Figure 4:
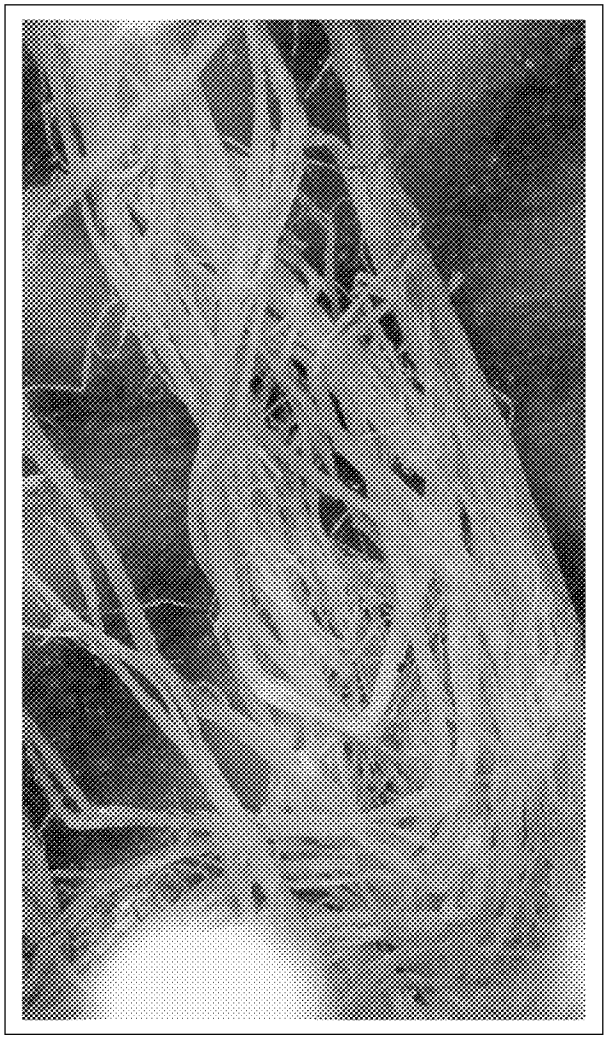
FIG. 4 shows a microscopic image of an exemplary blended pulp (bast/hurd) prepared in accordance with methods of the present disclosure.

Blending of the bast fiber pulp prepared by Trial 2A and the hurd fiber pulp prepared by Trial 3A was performed by hand mixing the two pulp components. The blended pulp (bast/hurd) was boiled in hydrogen peroxide for 1 hour and then dried. It was found that the blended pulp (bast/hurd) yielded a soft fibrous pulp with good fiber length of bast fiber. The hurd was coming apart with good shear, good fiber and good strength. Upon independent examination by a paper expert, the blended pulp was determined to be a high quality pulp product. A microscopic image (10× magnification) of a representative sample of this blended pulp is shown in FIG. 4. There remained some woodier hurd bits in the blended pulp, which should be resolved in larger scale processing (e.g. industrial scale) by use of a screen (e.g. Trommel Drum Screen).

Example 5

In an exemplary industrial scale process, the bast fiber pulp prepared in accordance with the present disclosure (e.g. Trial 2C) and the hurd fiber pulp prepared accordance with the present disclosure (e.g. Trial 3B) are added to a blend chest at a predefined ratio to produce a blended pulp (bast/hurd). In an embodiment, the predefined ratio is 70% v/v bast fiber pulp/30% v/v hurd fiber pulp.

The predefined ratio between the bast fiber pulp and the hurd fiber pulp may be any suitable ratio based on characteristics of the starting plant material and resultant pulp (e.g. based on cellulose content). For example, an optimal amount of each of the bast fiber pulp and hurd fiber pulp for blending, and thereby the predefined ratio therebetween in the blended pulp, may differ based on growth conditions of the plants (e.g. yearly variance, species variance, location, crop type—e.g. dry versus irrigated, etc.), which for example may impact the cellulose, hemicellulose and lignin content and thereby alter the predefined fiber ratios.

The blended pulp (bast/hurd) is capable of being used to form paper products, for example by low temperature drying, cutting, and rolling into sheets.

As used herein, the term "about" refers to an approximately +/−10% variation from a given value. It is to be understood that such a variation is always included in any given value provided herein, whether or not it is specifically referred to.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Although individual embodiments are discussed, the disclosure covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

Many obvious variations of the embodiments set out herein will suggest themselves to those skilled in the art in light of the present disclosure. Such obvious variations are within the full intended scope of the appended claims.

What is claimed:

1. A method for producing a pulp or paper product from a plant material having bast and hurd fibers, the method comprising:

processing of a plant hurd fiber material into a hurd fiber pulp or pulp slurry in a first stream comprising a hurd pre-treatment step followed by a mechanical refining;

processing of a plant bast fiber material into a bast fiber pulp or pulp slurry in a second stream;

blending of the hurd fiber pulp or pulp slurry and the bast fiber pulp or pulp slurry to provide a blended pulp or pulp slurry; and producing the pulp or paper product from the blended pulp or pulp slurry, wherein the first stream and the second stream are performed separate from each other, and wherein the hurd pre-treatment step in the first stream comprises a chemical treatment comprising heating the plant hurd fiber material in a citric acid solution followed by heating the plant hurd material in a sodium bicarbonate solution.

2. The method of claim 1, wherein processing of the plant bast fiber material into the bast fiber pulp or pulp slurry in the second stream comprises a steam and pressure refining of the plant bast fiber material.

3. The method of claim 2, which further comprises a step of:

decorticating a plant material having bast and hurd fibers to separate and provide the plant bast fiber material and the plant hurd fiber material.

4. The method of claim 3, further comprising:

initiating, in the first stream, a cyclone separation in an absence of steam, following the mechanical refining, to provide the hurd fiber pulp or pulp slurry.

5. The method of claim 2, wherein the steam and pressure refining in the second stream comprises one or more steps of chemical pulping of the plant bast fiber material.

6. The method of claim 5, wherein the one or more steps of chemical pulping comprises heating the plant bast fiber material in a presence of citric acid, sulfur dioxide, sulfuric acid, sodium hydroxide, sodium bicarbonate, or any combination thereof together or separate, under steam and pressure conditions.

7. The method of claim 6, wherein the one or more steps of chemical pulping comprises heating the plant bast material in a citric acid solution followed by heating the plant hurd material in a sodium bicarbonate solution, both under steam and pressure conditions.

8. The method of claim 2, wherein the second stream comprises a bast pre-treatment step of subjecting the plant bast fiber material to a second stream oxygen delignification, followed by the steam and pressure refining.

9. The method of claim 8, wherein the second stream oxygen delignification comprises heating the plant bast fiber material in a presence of $O_2$ in a pressure vessel.

10. The method of claim 9, which comprises a step treating the plant bast fiber material with sulfur dioxide, sodium hydroxide or citric acid prior to the second stream oxygen delignification.

11. The method of claim 8, wherein forming the bast fiber pulp or pulp slurry comprises the steps of:

performing the bast pre-treatment step;

washing and screening the plant bast fiber material;

pre-treating the washed plant bast fiber material with steam;

performing the steam and pressure refining;

performing a steam separation step in a cyclone to remove the steam from the steam and pressure refining; and removing latency and screening to form the bast fiber pulp or pulp slurry.

12. The method of claim 2, further comprising a steam separation step in a cyclone to remove steam from the plant bast fiber material after the steam and pressure refining.

13. The method of claim 1, wherein the mechanical refining of the plant hurd fiber material in the first stream is an atmospheric mechanical refining.

14. The method of claim 1, wherein the hurd pre-treatment step comprises subjecting the plant hurd fiber material to both the chemical treatment and a first stream oxygen delignification, followed by the mechanical refining.

15. The method of claim 14, wherein the first stream oxygen delignification comprises heating the plant hurd fiber material in a presence of $O_2$ in a pressure vessel.

16. The method of claim 1, wherein the chemical treatment comprises heating the plant hurd fiber material the citric acid solution in a presence of sulfur dioxide, sulfuric acid, sodium hydroxide, sodium bicarbonate, or any combination thereof together or separate.

17. The method of claim 6, wherein forming the hurd fiber pulp or pulp slurry in the first stream comprises the steps of:

performing the hurd pre-treatment step;

washing and screening the plant hurd fiber material;

performing the mechanical refining;

performing a cyclone separation in an absence of steam; and removing latency and screening to form the hurd fiber pulp or pulp slurry.

18. The method of claim 1, wherein the blending of the hurd fiber pulp or pulp slurry and the bast fiber pulp or pulp slurry is performed in a blend chest.

19. The method of claim 18, wherein the blend chest mixes the hurd fiber pulp or pulp slurry and the bast fiber pulp or pulp slurry into a substantially homogeneous mixture to provide the blended pulp or pulp slurry.

20. The method of claim 19, wherein the substantially homogeneous mixture is subject to one or more of a blended pulp oxygen delignification step and a blended pulp latency and screening step, to provide the blended pulp or pulp slurry.

21. The method of claim 1, wherein producing the pulp or the paper product from the blended pulp or pulp slurry comprises one or more steps of washing, dewatering, and drying.

22. The method of claim 1, wherein the blended pulp or pulp slurry comprises a ratio of between 5:1 and 1:5 of hurd fiber pulp or pulp slurry:bast fiber pulp or pulp slurry on a volume/volume (v/v) basis.

23. The method of claim 22, wherein the blended pulp or pulp slurry comprises between about 20% v/v to about 80% v/v of the hurd fiber pulp slurry, and is brought up to 100% with the bast fiber pulp slurry.

24. The method of claim 22, wherein the blended pulp or pulp slurry comprises about 70% v/v of the bast fiber pulp or pulp slurry and about 30% v/v of the hurd fiber pulp or pulp slurry.

25. The method of claim 1, wherein the plant material having bast and hurd fibers is a cannabis, flax, sunn, kenaf, mulberry, or mitsumata plant material.

26. The method of claim 1, wherein the plant material having bast and hurd fibers is a cannabis plant material or a flax plant material.

27. The method of claim 1, wherein the plant material having bast and hurd fibers is a cannabis plant material.

28. The method of claim 27, wherein the cannabis plant material is hemp.

29. A method for producing a pulp or paper product from a plant material having bast and hurd fibers, the method comprising:

processing of a plant hurd fiber material into a hurd fiber pulp or pulp slurry in a first stream;

processing of a plant bast fiber material into a bast fiber pulp or pulp slurry in a second stream comprising steam and pressure refining of the plant bast fiber material;

blending of the hurd fiber pulp or pulp slurry and the bast fiber pulp or pulp slurry to provide a blended pulp or pulp slurry; and producing the pulp or paper product from the blended pulp or pulp slurry, wherein the first stream and the second stream are performed separate from each other, and wherein the steam and pressure refining in the second stream comprises a chemical pulping of the plant bast fiber material comprising heating the plant bast material in a citric acid solution followed by heating the plant bast material in a sodium bicarbonate solution, both under steam and pressure conditions.

30. The method of claim 29, wherein processing of the plant hurd fiber material into the hurd fiber pulp or pulp slurry in the first stream comprises a mechanical refining.

31. The method of claim 30, wherein the first stream comprises a hurd pre-treatment step of subjecting the plant hurd fiber material to one or both of a chemical treatment or a first stream oxygen delignification, followed by the mechanical refining.

32. The method of claim 31, wherein the hurd pre-treatment step is by the first stream oxygen delignification and comprises heating the plant hurd fiber material in a presence of $O_2$ in a pressure vessel.

33. The method of claim 32, further comprising:

treating the plant hurd fiber material with sulfur dioxide, sodium hydroxide or citric acid prior to the first stream oxygen delignification.

34. The method of claim 33, wherein the hurd pre-treatment step comprises heating the plant hurd material in a citric acid solution followed by heating the plant hurd material in a sodium bicarbonate solution.

35. The method of claim 31, wherein the hurd pre-treatment step is by the chemical treatment and comprises heating the plant hurd fiber material in a presence of citric acid, sulfur dioxide, sulfuric acid, sodium hydroxide, sodium bicarbonate, or any combination thereof together or separate.

* * * * *